US010020582B2

(12) United States Patent
Tsubaki et al.

(10) Patent No.: US 10,020,582 B2
(45) Date of Patent: Jul. 10, 2018

(54) COIL ANTENNA AND COMMUNICATION TERMINAL DEVICE

(71) Applicant: Murata Manufacturing Co., Ltd., Nagaokakyo-shi, Kyoto-fu (JP)

(72) Inventors: Nobuhito Tsubaki, Nagaokakyo (JP); Takashi Noma, Nagaokakyo (JP); Noboru Kato, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 371 days.

(21) Appl. No.: 14/918,747

(22) Filed: Oct. 21, 2015

(65) Prior Publication Data

US 2016/0043469 A1 Feb. 11, 2016

Related U.S. Application Data

(63) Continuation of application No. 14/221,356, filed on Mar. 21, 2014, now Pat. No. 9,214,728, which is a (Continued)

(30) Foreign Application Priority Data

Apr. 27, 2012 (JP) ..... 2012-102622
Mar. 19, 2013 (JP) ..... 2013-056453

(51) Int. Cl.
*H01Q 7/08* (2006.01)
*H01Q 19/00* (2006.01)
(Continued)

(52) U.S. Cl.
CPC ..... *H01Q 7/08* (2013.01); *H01Q 1/243* (2013.01); *H01Q 7/06* (2013.01); *H01Q 19/00* (2013.01)

(58) Field of Classification Search
CPC ..... H01Q 7/08; H01Q 7/06; H01Q 1/273
(Continued)

(56) References Cited

U.S. PATENT DOCUMENTS

2003/0132892 A1* 7/2003 Yde-Andersen ... G08B 13/2414 343/895
2007/0001921 A1* 1/2007 Takahashi ..... H01Q 1/38 343/788
(Continued)

FOREIGN PATENT DOCUMENTS

JP 2005-294686 A 10/2005
RU 2 256 264 C1 7/2005
WO 2007/074580 A1 7/2007

OTHER PUBLICATIONS

Official Communication issued in corresponding Great Britain Patent Application No. 1321952.2, dated Feb. 4, 2016.
(Continued)

*Primary Examiner* — Dameon E Levi
*Assistant Examiner* — Collin Dawkins
(74) *Attorney, Agent, or Firm* — Keating & Bennett, LLP

(57) ABSTRACT

To ensure a sufficient communication distance and to concurrently suppress a conductor loss, a coil antenna includes a magnetic core including a first peripheral surface including at least a first principal surface, a first coil conductor located on the first principal surface and wound around a predetermined winding axis, a first base material layer stacked on the first principal surface, including at least a first surface parallel or substantially parallel to the first principal surface, and made of a material having a lower magnetic permeability than the magnetic core, and a second coil conductor located on at least the first surface. Opposite ends of the second coil conductor are coupled to the first coil conductor on the first principal surface, and a direction in which a current flows through the first coil conductor on the first
(Continued)

principal surface is substantially the same as a direction in which a current flows through the second coil conductor on the first surface.

18 Claims, 35 Drawing Sheets

Related U.S. Application Data continuation of application No. PCT/JP2013/061185, filed on Apr. 15, 2013.

(51) Int. Cl.
*H01Q 7/06* (2006.01)
*H01Q 1/24* (2006.01)

(58) Field of Classification Search
USPC ..... 343/788, 702, 787
See application file for complete search history.

(56) References Cited

U.S. PATENT DOCUMENTS

2009/0128437 A1 5/2009 Sonoda et al.
2011/0049249 A1* 3/2011 Kato ..... G06K 19/07749 235/492

OTHER PUBLICATIONS

Tsubaki et al., "Coil Antenna and Communication Terminal Device", U.S. Appl. No. 14/221,356, filed Mar. 21, 2014.

* cited by examiner

COIL ANTENNA AND COMMUNICATION TERMINAL DEVICE

BACKGROUND OF THE INVENTION

1. Field of the Invention

The present invention relates to a coil antenna including a coil conductor that is arranged around a magnetic core, and to a communication terminal device including the coil antenna.

2. Description of the Related Art

In the above-mentioned type of coil antenna, when a magnetic field generated on the communication partner side interlinks with a coil, an induced electromotive force is generated across the coil. In the above-mentioned type of communication terminal device, data superimposed on the induced electromotive force is reproduced, whereby the data from the communication partner side is received. Furthermore, in the coil antenna, when a current is supplied to flow through the coil, a magnetic field is generated around the coil. The communication terminal device transmits data to the communication partner by employing the generated magnetic field. Hitherto, examples of such coil antenna have been disclosed in Japanese Unexamined Patent Application Publication No. 2003-284476, Japanese Unexamined Patent Application Publication No. 2003-283231 and Japanese Unexamined Patent Application Publication No. 2007-19891.

When trying to reduce the size of the above-described coil antenna, it is conceivable, for example, to narrow a line width of the coil, or to use a material having a high magnetic permeability as a magnetic core. However, if the line width of the coil is narrowed, the influence of a conductor loss would be non-negligible. If the material having a high magnetic permeability is used as the magnetic core, the magnetic field would be confined and therefore a sufficient communication distance could not be ensured.

SUMMARY OF THE INVENTION

Accordingly, preferred embodiments of the present invention provide a coil antenna capable of ensuring a sufficient communication distance while suppressing a conductor loss, and a communication terminal device including the coil antenna.

According to a preferred embodiment of the present invention, a coil antenna includes a magnetic core including a first peripheral surface including at least a first principal surface, a first coil conductor located on the first principal surface and wound around a predetermined winding axis, a first base material layer stacked on the first principal surface, including at least a first surface parallel or substantially parallel to the first principal surface, and made of a material having a lower magnetic permeability than the magnetic core, and a second coil conductor located on at least the first surface.

In the coil antenna described above, opposite ends of the second coil conductor are coupled to the first coil conductor on the first principal surface, and a direction in which a current flows through the first coil conductor on the first principal surface is substantially the same as a direction in which a current flows through the second coil conductor on the first surface.

Furthermore, the above-described coil antenna is mounted on a communication terminal device, for example.

According to various preferred embodiments of the present invention, a sufficient communication distance is ensured while a conductor loss is suppressed.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
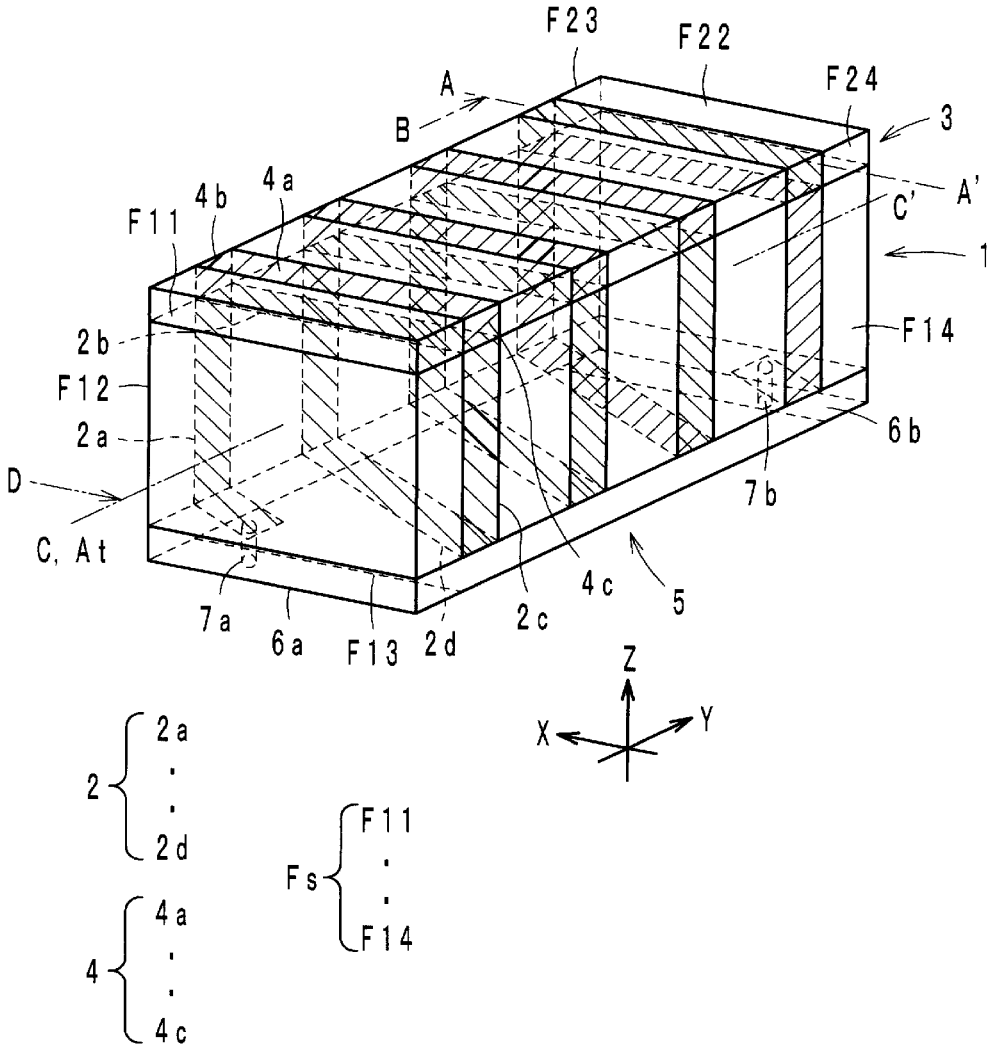
FIG. 1 is a perspective view of a coil antenna according to a first preferred embodiment of the present invention.

Prior to the following description of coil antennas according to preferred embodiments of the present invention, X-, Y- and Z-axes denoted in the drawings are defined as follows. The X-, Y- and Z-axes indicate, respectively, the right and left direction (transverse direction), the back and forth direction (longitudinal direction), and the up and down direction (height or thickness direction) of the coil antenna.

First Preferred Embodiment

Figure 2:
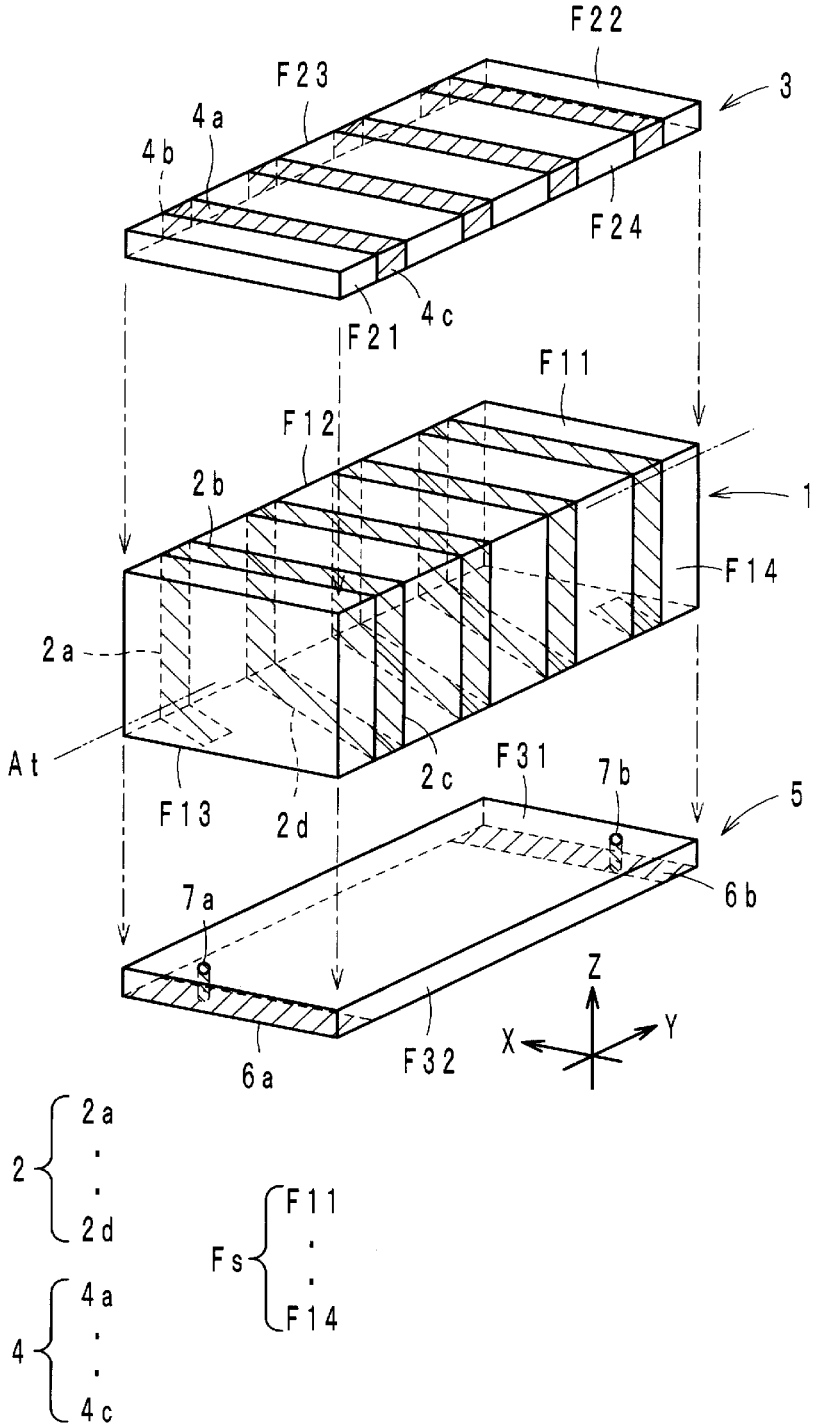
FIG. 2 is an exploded view of the coil antenna of FIG. 1.

As illustrated in FIGS. 1 and 2, the coil antenna includes a magnetic core 1, a first coil conductor 2, a first base material layer 3, at least one second coil conductor 4, a first insulator layer 5, a first outer electrode 6*a*, a second outer electrode 6*b*, a first via electrode 7*a*, and a second via electrode 7*b*.

The magnetic core 1 is made of a magnetic material having a relatively high magnetic permeability $\mu_h$ (e.g., 100 or more). One example of such a magnetic material is Ni—Zn—Cu-based ferrite. The magnetic core 1 preferably has a rectangular or a substantially rectangular parallelepiped shape. A transverse size, a longitudinal size, and a height of the magnetic core 1 are, for example, about 5 mm, about 10 mm, and about 0.55 mm, respectively. The magnetic core 1 includes a peripheral surface Fs that is parallel or substantially parallel to a winding axis At, and front and rear end surfaces that are perpendicular or substantially perpendicular to the winding axis At.

As clearly seen from FIG. 2, the peripheral surface Fs includes an upper surface F11, a right lateral surface F12, a lower surface F13, and a left lateral surface F14. The upper surface F11 and the lower surface F13 are parallel or substantially parallel to an XY-plane and are opposed to each other in the up and down direction. The right lateral surface F12 and the left lateral surface F14 are parallel or substantially parallel to a YZ-plane and are opposed to each other in the right and left direction. In the following description, the upper surface F11 is also called a first principal surface F11 and the lower surface F13 is also called a second principal surface F13 in some cases.

The first coil conductor 2 defines a helical coil made of a conductive material, e.g., silver. More specifically, the first coil conductor 2 is arranged on the peripheral surface Fs in a spirally wound shape around the winding axis At. In the example illustrated in FIG. 1, the number of turns preferably is four, for example, and the turns of the first coil conductor 2 are each mainly constituted by a conductor pattern 2*a* located on the right lateral surface F12, a conductor pattern 2*b* located on the first principal surface F11, a conductor pattern 2*c* located on the left lateral surface F14, and a conductor pattern 2*d* located on the second principal surface F13. It is to be noted that, for the sake of convenience in illustration, reference symbols are attached to only the conductor patterns for one turn in FIGS. 1 and 2.

Figure 3:
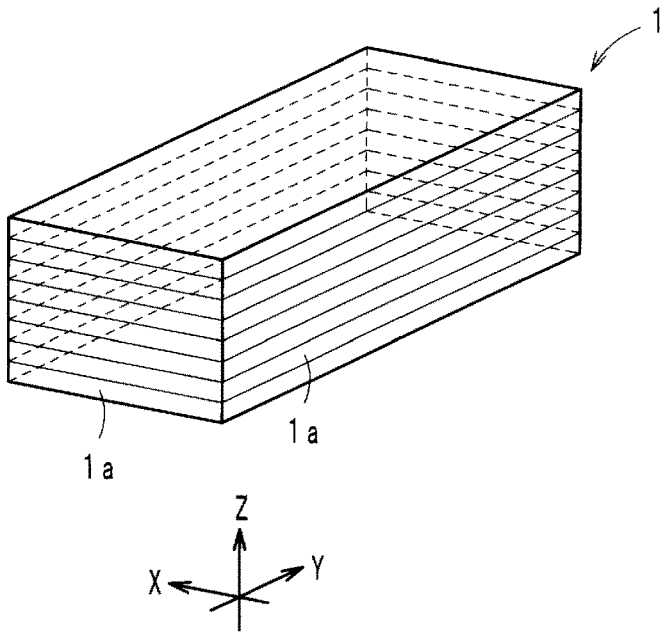
FIG. 3 is a perspective view of a magnetic core including a plurality of magnetic layers.

The magnetic core 1 may be fabricated as a block body having the above-mentioned sizes in its intrinsic form without fabricating a multilayer body. Alternatively, as illustrated in FIG. 3, the magnetic core 1 may be fabricated by stacking a plurality of magnetic layers 1*a* one above another. It is to be noted that, for the sake of convenience in illustration, the reference symbol 1*a* is attached to only two magnetic layers in FIG. 3. Furthermore, thicknesses of the individual magnetic layers 1*a* may be equal to each other or not so. With a structure including the plural magnetic layers 1*a*, it is possible to simply adjust the height of the magnetic core 1, and to reduce brittleness thereof.

Referring to FIGS. 1 and 2 again, the first base material layer 3 is made of, for example, an insulating material. The insulating material has a magnetic permeability that is close to the magnetic permeability $\mu_0$ in vacuum or the atmosphere, and that is smaller than the magnetic permeability $\mu_h$ of the magnetic core 1. The first base material layer 3 is stacked on the first principal surface F11 on which the first coil conductor 2 is located, and it has a predetermined thickness in the up and down direction. The thickness of the first base material layer 3 in the up and down direction is sufficiently smaller than the transverse size of the magnetic core 1 and preferably is, for example, about 100 μm to about 1000 μm. A transverse size and a longitudinal size of the first base material layer 3 are substantially the same values as the respective sizes of the magnetic core 1.

As clearly seen from FIG. 2, the first base material layer 3 includes at least a joining surface F21, a first surface F22, a right lateral surface F23, and a left lateral surface F24. The joining surface F21 and the first surface F22 are parallel or substantially parallel to the XY-plane. The joining surface F21 is contacted with the first principal surface F11, and the first surface F22 is opposed to the joining surface F21 in the up and down direction. The right lateral surface F23 and the left lateral surface F24 are parallel or substantially parallel to the YZ-plane, and they connect the joining surface F21 and the first surface F22 to each other.

While, in this preferred embodiment, the first base material layer 3 is described as being made of an insulating material, the material of the first base material layer 3 is not limited to the insulating material, and the first base material layer 3 may be made of a dielectric material or a magnetic material having a lower magnetic permeability than the above-mentioned magnetic permeability $\mu_h$. Furthermore, the first base material layer 3 may be made of a material having a magnetic permeability smaller than that of the magnetic core 1 at temperature in use (e.g., about 25° C.). When the first base material layer 3 is made of a magnetic material, Ni—Zn—Cu-based ferrite is used as in the magnetic core 1. In such a case, to reduce the magnetic permeability, at least one predetermined additive is mixed into the first base material layer 3 when it is formed.

The second coil conductor 4 is made of a conductive material, e.g., silver, and is constituted by conductor patterns 4*a* to 4*c*. The conductor patterns 4*a* to 4*c* have line widths, which are not only equal to each other, but also equal to those of the conductor patterns 2*a* to 2*d*. Here, the line width implies a width measured in the direction of the winding axis At.

Figure 4:
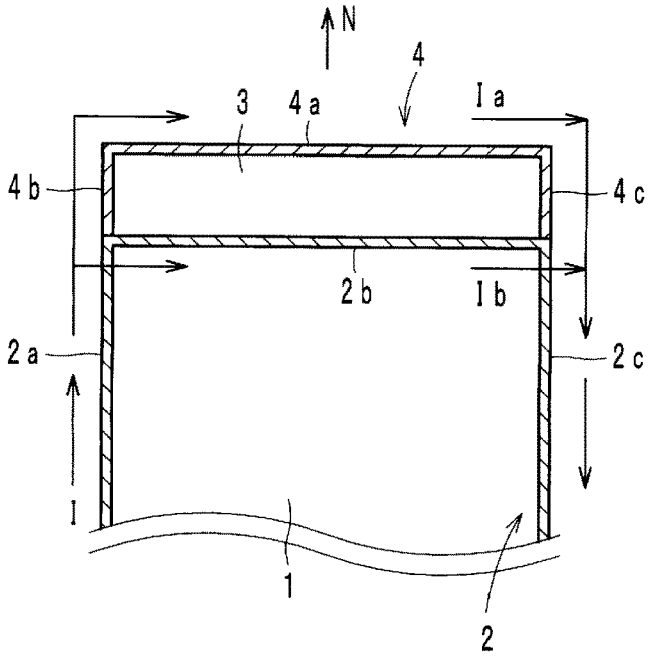
FIG. 4 is a vertical sectional view taken along a line A-A' in FIG. 1, looking at the section from the direction of an arrow B.
Figure 5:
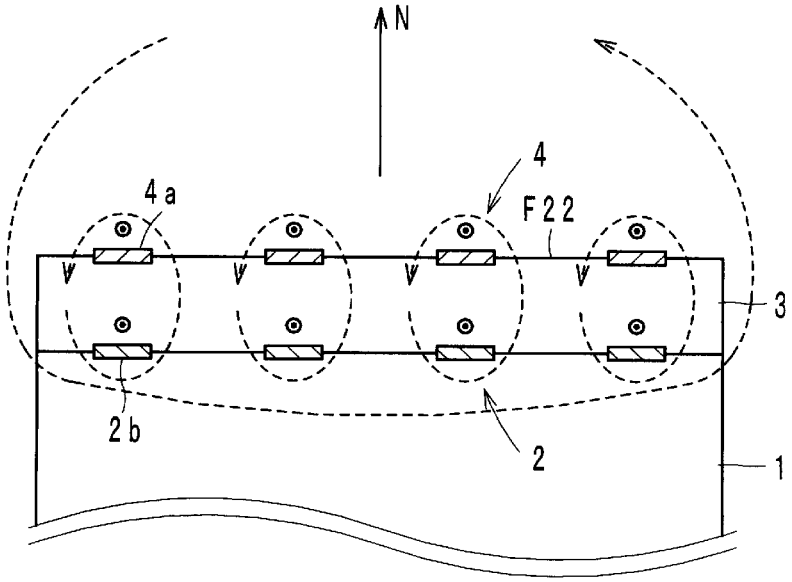
FIG. 5 is a longitudinal sectional view taken along a line C-C' in FIG. 1, looking at the section from the direction of an arrow D.

As illustrated in FIGS. 4 and 5, the conductor pattern 4*a* is arranged on the first surface F22 to be parallel or substantially parallel to the conductor pattern 2*b* of one turn constituting the first coil conductor 2 and to be overlapped with the conductor pattern 2*b* in a plan view when looking from the direction of a normal line N with respect to the first principal surface F11.

The conductor patterns 4*b* and 4*c* are located on the right lateral surface F23 and the left lateral surface F24, and they connect one end and the other end of the conductor pattern 4*a* to one end and the other end of the conductor pattern 2*b*, respectively.

In this preferred embodiment, the second coil conductor 4 is arranged corresponding to each turn of the first coil conductor 2. In other words, the second coil conductors 4 corresponding to four turns are located on the first base material layer 3.

In this preferred embodiment, the first insulator layer 5 is made of an insulating material as in the first base material layer 3, and it includes at least a joining surface F31 and a rear surface F32. The magnetic core 1 including the first coil conductor 2 located thereon is stacked on the joining surface F31. The rear surface F32 is opposed to the joining surface F31 in the up and down direction. The first outer electrode 6*a* and the second outer electrode 6*b* are located in a front end portion and a rear end portion of the rear surface F32, respectively.

Moreover, a through-hole penetrating from the rear surface F32 to the joining surface F31 is located in the first insulator layer 5 at a position above the first outer electrode 6*a*, and a first via electrode 7*a* is located in the through-hole. Similarly, a through-hole is provided in the first insulator layer 5 at a position above the second outer electrode 6*b*, and a second via electrode 7*b* is provided in the through-hole. One end of the first coil conductor 2 is connected to the first via electrode 7*a*, and the other end of the first coil conductor 2 is connected to the second via electrode 7*b*.

One example of a manufacturing method for the above-described coil antenna will be described below. The manufacturing method includes the following steps (1) to (6).

(1) For example, calcined ferrite powder is mixed with a binder, a plasticizer and so on in a ball mill such that the desired magnetic permeability $\mu_h$ (e.g., 100 or more) is obtained after sintering. The thus-obtained slurry is shaped by the doctor blade method, for example, so as to have a predetermined size through the sintering, such that a first sheet material serving as a base of the magnetic core 1 is obtained.

(2) Through-holes for the conductor patterns 2*a* and 2*c* are formed in the first sheet material, obtained in above (1), by using a laser or a punching press. An electrode paste made of Ag, for example, is filled in each of the through-holes. Furthermore, an electrode paste is coated on the surface of the first sheet material by screen printing, for example, whereby the conductor patterns 2*b* and 2*d* are formed. The above-mentioned first sheet material is stacked in a desired number.

(3) To fabricate the first base material layer 3 and the first insulator layer 5, calcined ferrite powder is mixed with a binder, a plasticizer and so on in a ball mill. Thus-obtained slurry is shaped by the doctor blade method, for example, such that second sheet materials serving as bases for the first base material layer 3 and the first insulator layer 5 are obtained.

(4) Through-holes for the first and second via electrodes 7*a* and 7*b* are formed in one of the second sheet materials obtained in above (3). An electrode paste is filled in the through-holes, such that the first and second via electrodes 7*a* and 7*b* are formed. Moreover, the second sheet material in which the first and second via electrodes 7*a* and 7*b* have been formed is compressed, as appropriate, such that a desired thickness is obtained after sintering. As a result, the first insulator layer 5 is fabricated.

(5) Through-holes for the conductor patterns 4*b* and 4*c* are formed in the other second sheet material obtained in above (3), and an electrode paste is filled in the through-holes. Furthermore, on the other second sheet material of which surface serves as the first surface F22, an electrode paste is coated by screen printing, for example, whereby the conductor pattern 4*a* is formed. The above-mentioned second sheet material is compressed as appropriate. As a result, the first base material layer 3 is fabricated.

(6) After bonding the first insulator layer 5, the magnetic core 1, and the first base material layer 3, which have been obtained as described above, together under pressure, they are fired under conditions of 900° C. for 2 hours, for example, and are then subjected to dicing. As a result, the coil antenna is obtained.

Figure 6:
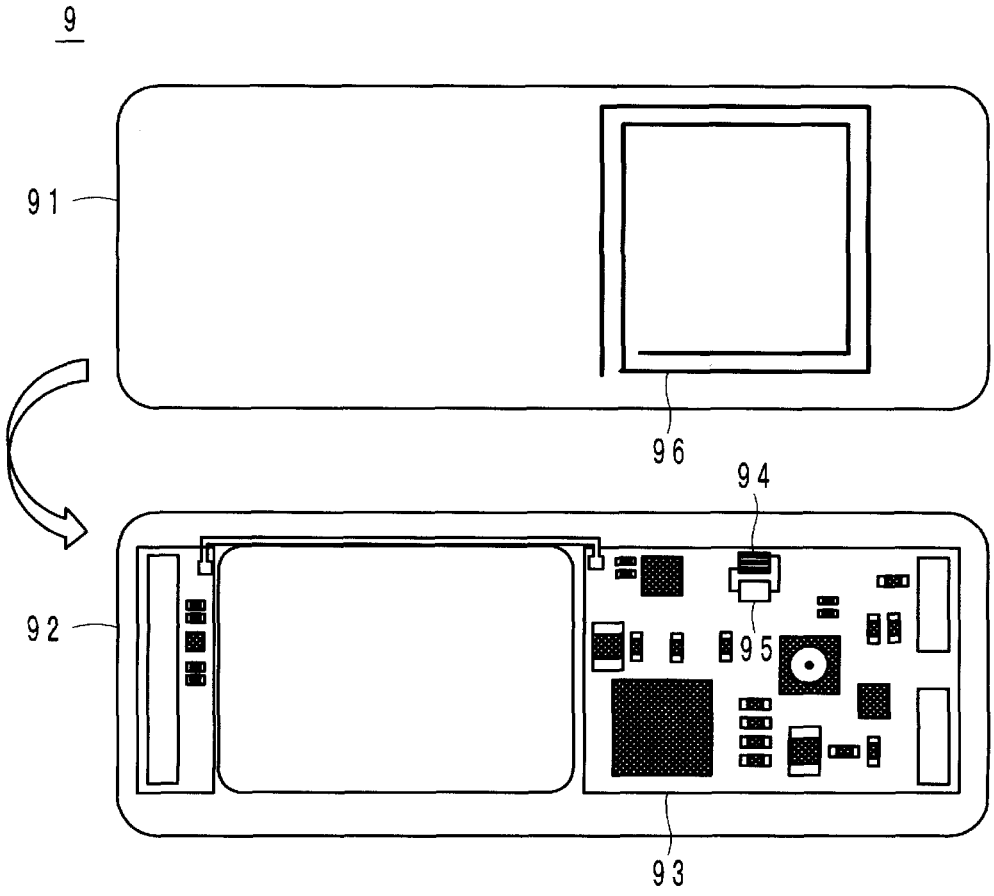
FIG. 6 illustrates a communication terminal device including the coil antenna of FIG. 1.

The above-described coil antenna is used in a communication terminal device adapted for NFC (Near Field Communication) in a band of 13.56 MHz. FIG. 6 illustrates a communication terminal device 9 in a state of a casing cover 91 being opened, and further illustrates various components and various members, which are contained in a casing 92 of the communication terminal device 9. The communication terminal device 9 is typically a cellular phone and includes, inside the casing 92, a printed wiring board 93, a coil antenna 94, an IC chip 95, and a booster antenna 96, for example. In addition to the above-mentioned components, a battery pack, a camera, a UHF band antenna, and various circuit elements are mounted and arranged inside the casing 92 at a high density. Because those components are not important elements in the present invention, the description of those components is omitted.

Figure 7:
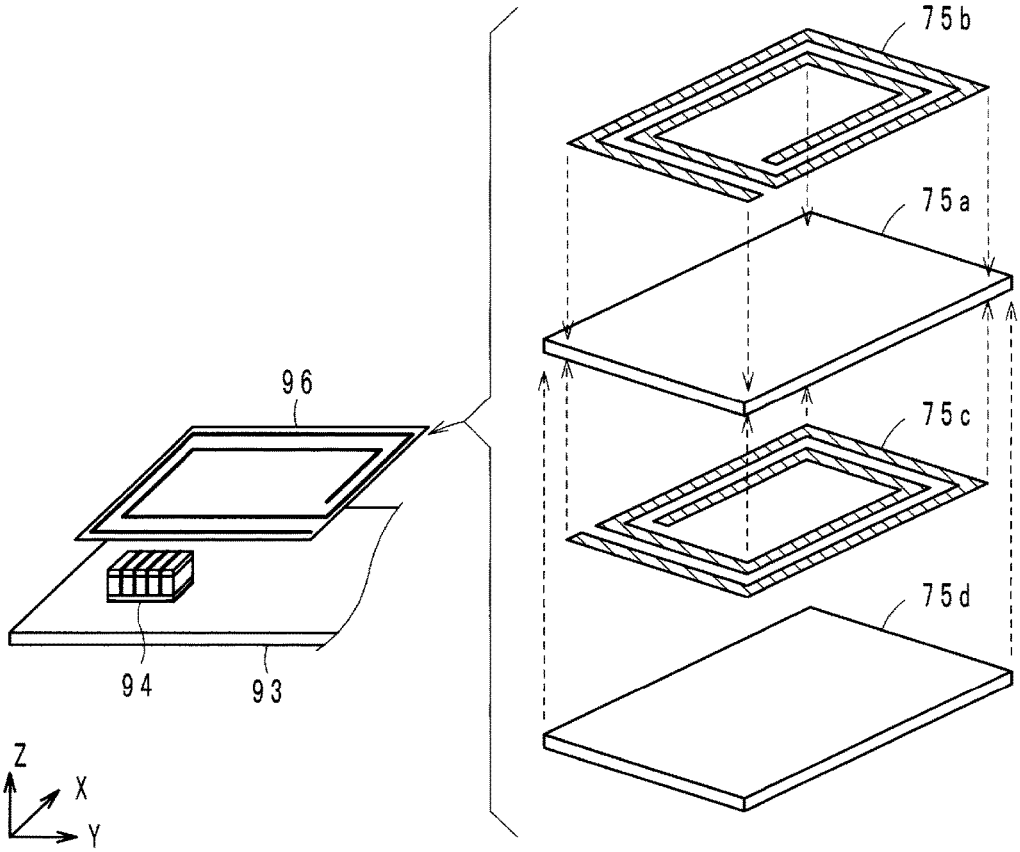
FIG. 7 illustrates a detailed configuration of a booster antenna in FIG. 6.

The coil antenna 94 is similar to that described above with reference to FIGS. 1 and 2, and is mounted on the printed wiring board 93 along with the IC chip 95, as illustrated in FIGS. 6 and 7. Furthermore, as illustrated in an equivalent circuit diagram of FIG. 8, the IC chip 95 is connected to opposite ends of the coil antenna 94, and a capacitor 97 is connected in parallel to the IC chip 95. The coil antenna 94, the IC chip 95, and the capacitor 97 constitute a feeder circuit 98. Assuming here that an inductance value of the coil antenna 94 is L1 and a capacitance value of the capacitor 97 is C1, the resonance frequency of the feeder circuit is determined depending on L1 and C1. A resistance component R1 of the coil antenna 94 is further illustrated in FIG. 8. A matching circuit may be connected, as required, between the coil antenna 94 and the IC chip 95 in some cases.

The booster antenna 96 is attached to the casing cover in such a state that the booster antenna 96 is positioned above the coil antenna 94 when the casing 92 is closed by the casing cover 91. In the example illustrated in FIG. 7, the booster antenna 96 is, e.g., a planar spiral coil and is disposed for the purpose of increasing the communication distance of the coil antenna 94. An aperture size (transverse size×longitudinal size) of the booster antenna 96 is larger than that (transverse size×height) of the coil antenna 94.

Figure 9A:
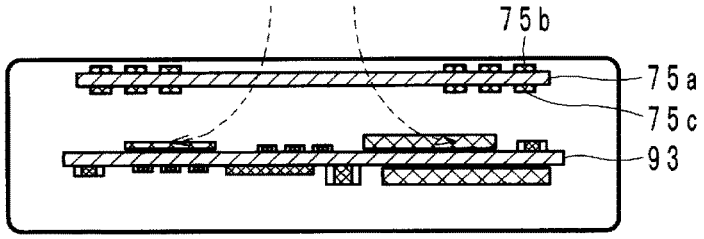
FIGS. 9A and 9B are schematic views to explain the effect resulting from the presence or the absence of a magnetic sheet material in the booster antenna in FIG. 6.
Figure 9B:
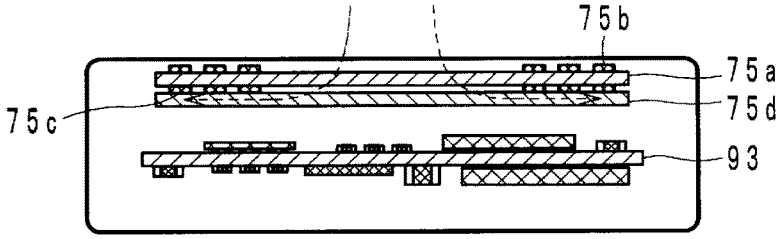

The booster antenna 96 includes, as illustrated in the right side of FIG. 7, a first planar coil conductor 75*b* and a second planar coil conductor 75*c* which are located on a front surface and a rear surface of an insulating sheet material 75*a*, respectively, with the first and second planar coil conductors being wound in directions reversed to each other. Furthermore, a magnetic sheet material 75*d* is affixed to a lower surface of the insulating sheet material 75*a*. If the insulating magnetic material 75*d* is not present, as illustrated in FIG. 9A, a portion of magnetic fluxes (denoted by dotted arrows) from the communication partner side would not pass the vicinity of the booster antenna 96 and would impinge against the printed wiring board 93. As a result, communication characteristics of the communication terminal device 9 would degrade due to the occurrence of an eddy current on the printed wiring board 93 and the occurrence of undesired coupling with the mounted components. In contrast, when the magnetic sheet material 75*d* is present, as illustrated in FIG. 9B, the magnetic fluxes are guided to pass the inside of the magnetic sheet material 75*d*, and they do not reach the printed wiring board 93. It is hence possible to avoid the above-mentioned degradation of communication characteristics of the communication terminal device 9.

Moreover, an interline capacitance is generated between the first planar coil conductor 75*b* and the second planar coil conductor 75*c*. Thus, as illustrated in the equivalent circuit diagram of FIG. 8, the first planar coil conductor 75*b* and the second planar coil conductor 75*c* can be regarded as being coupled to each other through capacitors 75*e* and 75*f*. It is assumed here that an inductance value of the first planar coil conductor 75*b* is L2, an inductance value of the second planar coil conductor 75*c* is L3, a capacitance value of the capacitor 75*e* is C2, and a capacitance value of the capacitor 75*f* is C3. In such a case, the resonance frequency of the booster antenna 96 is determined depending on L2, L3, C2 and C3.

In the communication terminal device 9 described above, as illustrated in FIG. 8, a current I is supplied to the coil antenna 94 from the IC chip 95. As illustrated in FIG. 4, the current I first flows through the conductor pattern 2*a* of the first coil conductor 2. The current I is then branched into a current flowing through the conductor pattern 2*b* of the first coil conductor 2 and a current flowing through the conductor pattern 4*b*, 4*a* and 4*c* of the second coil conductor 4. Thereafter, a current Ia having passed through the second coil conductor 4 flows in the same direction as a current Ib having passed through the first coil conductor 2. After joining together, both the currents flow through the conductor pattern 2*c*.

Thus, the second coil conductor 4 is arranged to branch from the first coil conductor 2, extending parallel or substantially parallel to the first coil conductor 2 with the first base material layer 3 interposed between the first and second coil conductors, and further joining with the first coil conductor 2 again. In comparison with the related art, therefore, a cross-sectional area of a current path can be significantly increased by an amount corresponding to a cross-sectional area of the second coil conductor 4, and the influence of a conductor loss is reduced.

As a solution for reducing the influence of a conductor loss, it would be conceivable to coat the first coil conductor in a larger thickness when carrying out the screen printing, and to increase the cross-sectional area of the first coil conductor. From a practical point of view in manufacturing, however, it is difficult to coat the first coil conductor in a larger thickness on conditions of a narrow gap between the conductor patterns constituting adjacent turns and of a high aspect ratio. For that reason, separating the current path into two branches as in this preferred embodiment is practically effective to reduce the influence of a conductor loss.

Figure 8:
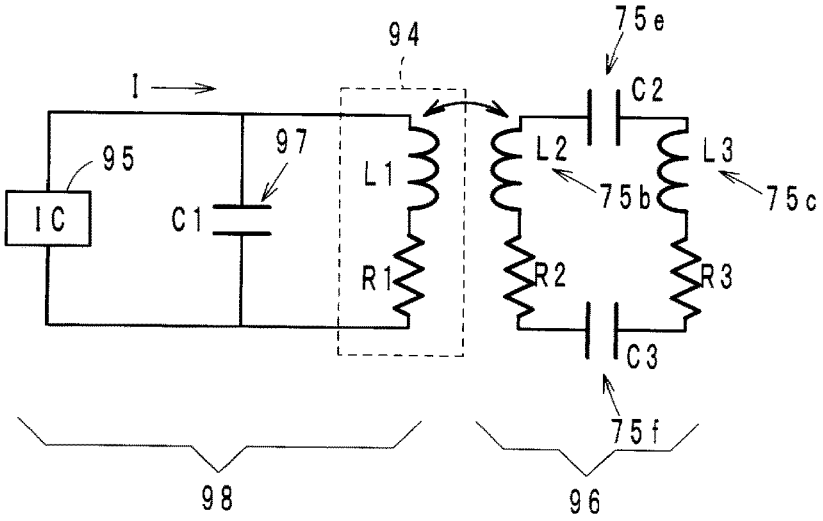
FIG. 8 is an equivalent circuit diagram of the booster antenna and a feeder circuit in FIG. 6.

Furthermore, the first coil conductor 2 and the second coil conductor 4 are closely positioned with the first base material layer 3 having the low magnetic permeability interposed therebetween. In addition, both the current flowing through the first coil conductor 2 and the current flowing through the second coil conductor 4 flow substantially in the same direction. Accordingly, magnetic fields generated around both the coil conductors 2 and 4 are coupled with each other as illustrated in FIG. 8. Moreover, because the side including the first surface F22 has a relatively low magnetic permeability, magnetic force lines spread in the direction of a normal line N with respect to the first surface F22. In other words, since the coil antenna 94 has strong directivity in the direction of the normal line N with respect to the first surface F22, a sufficient communication distance can be ensured in the direction of the normal line N away from the first surface F22.

In the first preferred embodiment, the booster antenna 96 is constituted to cause resonance by using the two first and second planar coil conductor 75*b* and 75*c* and the interline capacitance therebetween. However, the booster antenna 96 is not limited to such a configuration, and it may be constituted as follows.

Figure 10A:
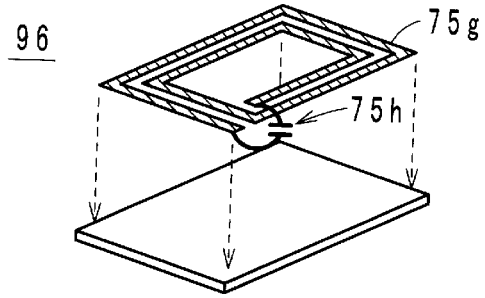
FIGS. 10A to 10C are schematic views illustrating different examples of the booster antenna in FIG. 6.
Figure 10B:
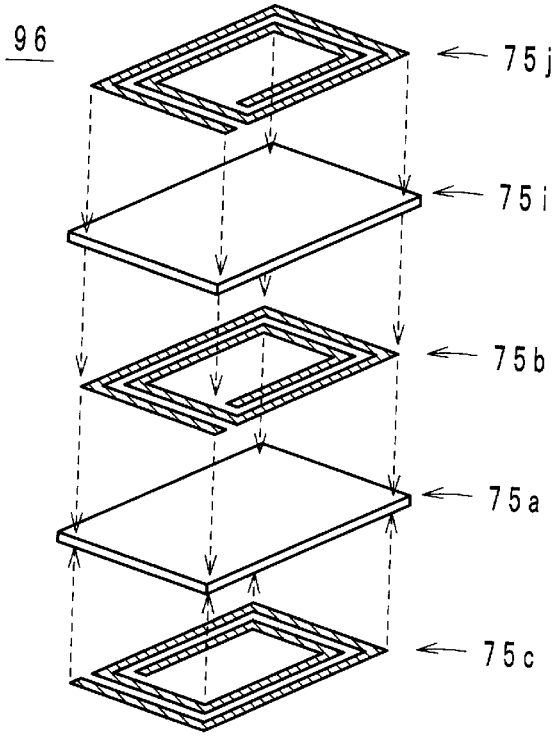
Figure 10C:
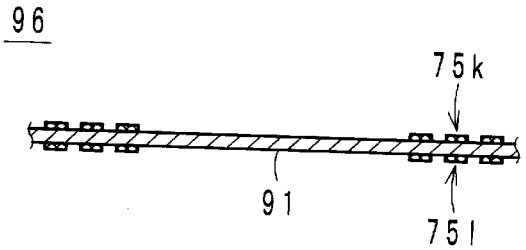

As illustrated in FIG. 10A, the booster antenna 96 may be constituted such that a capacitor element 75*h* is coupled to both ends of one planar coil conductor 75*g*. Alternatively, as illustrated in FIG. 10B, the booster antenna 96 may be constituted such that a second insulating sheet material 75*i* is affixed onto the first planar coil conductor 75*b* illustrated in FIG. 7, and that a third planar coil conductor 75*j* is located on the second insulating sheet material 75*i*. The number of layers of the planar coil conductors may be optionally selected. Furthermore, instead of providing the booster antenna 96 inside the casing 92, the booster antenna 96 may be realized, as illustrated in FIG. 10C, by forming planar coil conductor 75*k* and 751 on front and rear surfaces of the casing cover 91, respectively, through a drawing process using the MID method, for example.

First Modification of the First Preferred Embodiment

Figure 11:
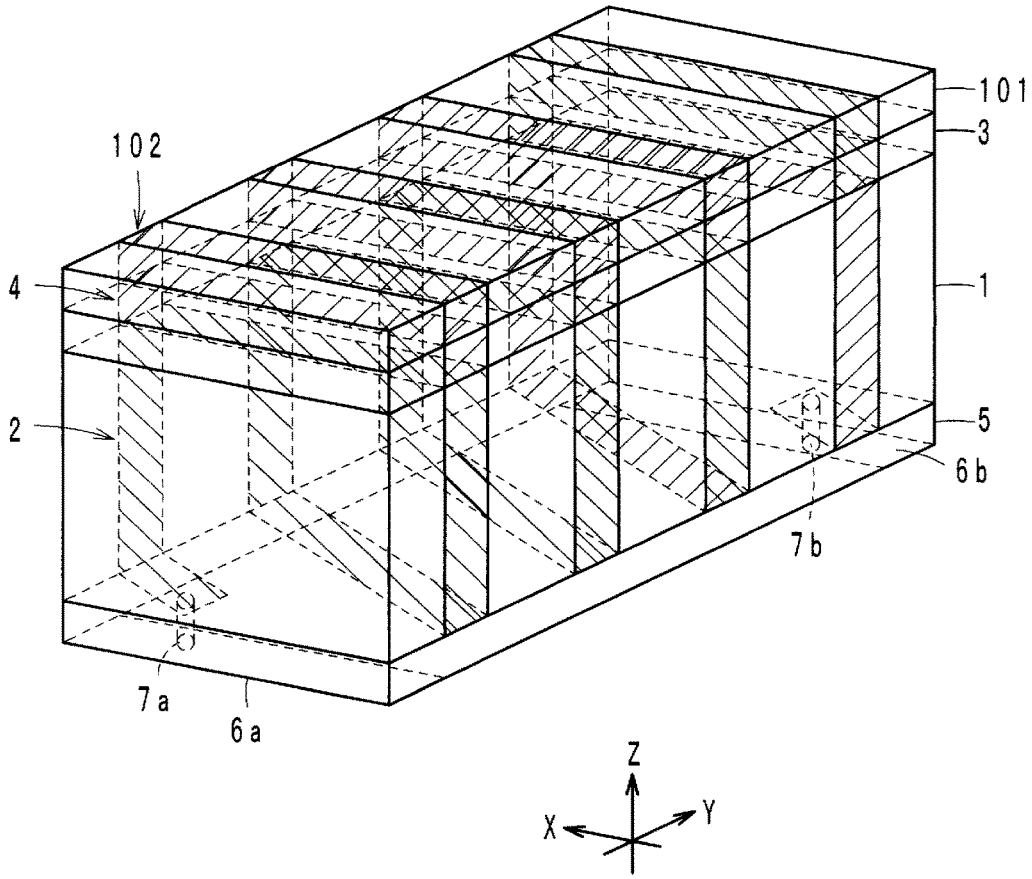
FIG. 11 is a perspective view of a coil antenna according to a first modification of a preferred embodiment of the present invention.
Figure 12:
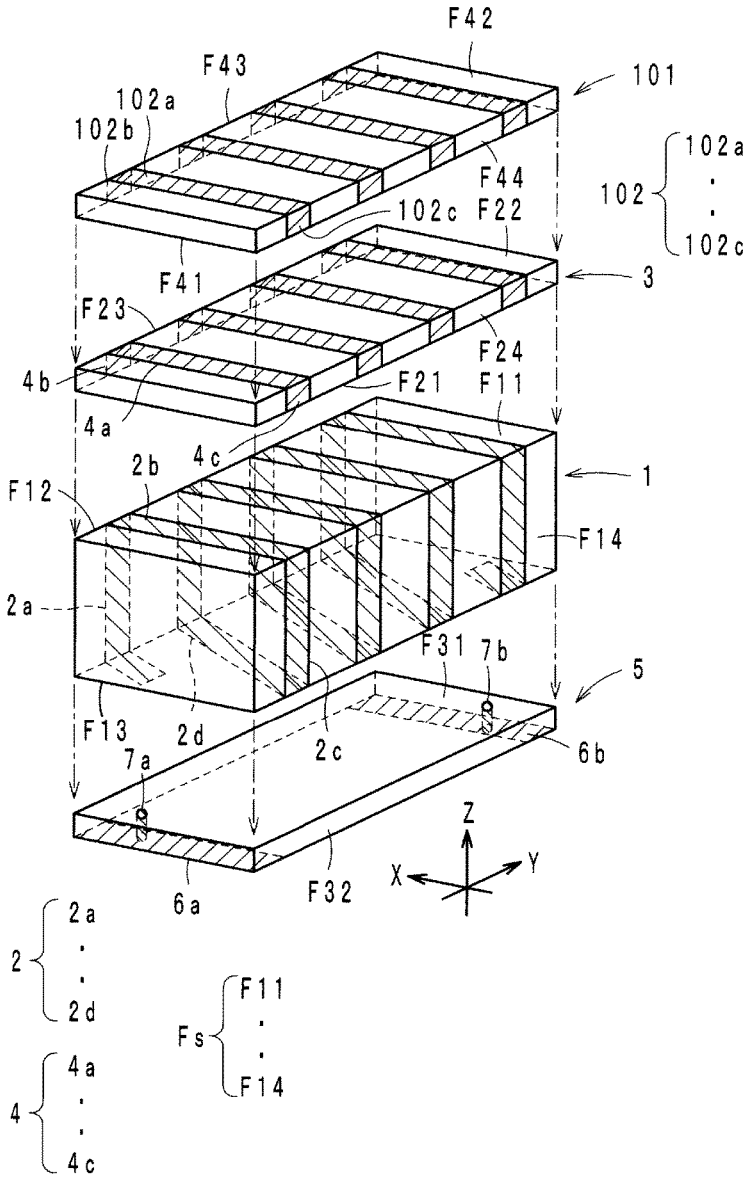
FIG. 12 is an exploded view of the coil antenna of FIG. 11.

In the first preferred embodiment described above, the second coil conductor 4 is disposed on the first principal surface F11 of the magnetic core 1 with the first base material layer 3 interposed therebetween. However, the coil antenna is not limited to such a configuration, and it may further include, as illustrated in FIGS. 11 and 12, a second base material layer 101 and a third coil conductor 102 in addition to the configuration illustrated in FIGS. 1 and 2.

Preferably, the material and the size of the second base material layer 101 are the same as those of the first base material layer 3. The second base material layer 101 is stacked on the first surface F22 of the first base material layer 3 and, as clearly seen from FIG. 12, it includes a joining surface F41, a second surface F42, a right lateral surface F43, and a left lateral surface F44. The joining surface F41 and the second surface F42 are parallel or substantially parallel to the XY-plane. The joining surface F41 is contacted with the first surface F22, and the second surface F42 is opposed to the joining surface F41 in the up and down direction. The right lateral surface F43 and the left lateral surface F44 are parallel or substantially parallel to the YZ-plane, and they connect the joining surface F41 and the second surface F42 to each other.

Preferably, the material and the line width of the third conductor 102 are the same as those of the second coil conductor 4. The third coil conductor 102 is constituted by conductor patterns 102*a* to 102*c*. The conductor pattern 102*a* is arranged on the second surface F42 to be parallel or substantially parallel to the conductor pattern 2*b* and to be overlapped with the conductor pattern 2*b* in a plan view when looking from the direction of the normal line N with respect to the first principal surface F11. The conductor patterns 102*b* and 102*c* are located on the right lateral surface F43 and the left lateral surface F44, and they connect one end and the other end of the conductor pattern 102*a* to the conductor patterns 4*b* and 4*c*, respectively. In first modification, like the second coil conductor 4, the third coil conductor 102 is also provided corresponding to each turn of the first coil conductor 2.

Thus, the coil antenna of the first modification is different from the coil antenna of the first preferred embodiment in that the third coil conductor 102 is additionally disposed with intervention of the second base material layer 101. In comparison with the first preferred embodiment, therefore, the cross-sectional area of the current path is significantly increased by an amount corresponding to a cross-sectional area of the third coil conductor 102, and the influence of a conductor loss is further reduced. Moreover, since the coil antenna of the first modification has stronger directivity in the direction of a normal line with respect to the second surface F42, a more sufficient communication distance is ensured.

Second Modification of the First Preferred Embodiment

Figure 13:
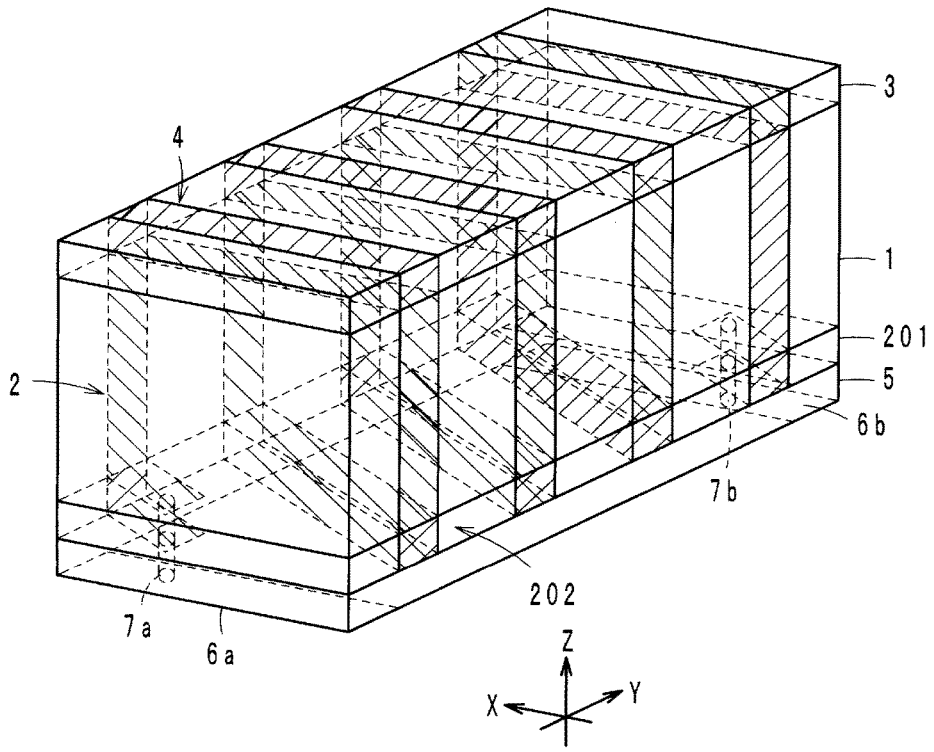
FIG. 13 is a perspective view of a coil antenna according to a second modification of a preferred embodiment of the present invention.
Figure 14:
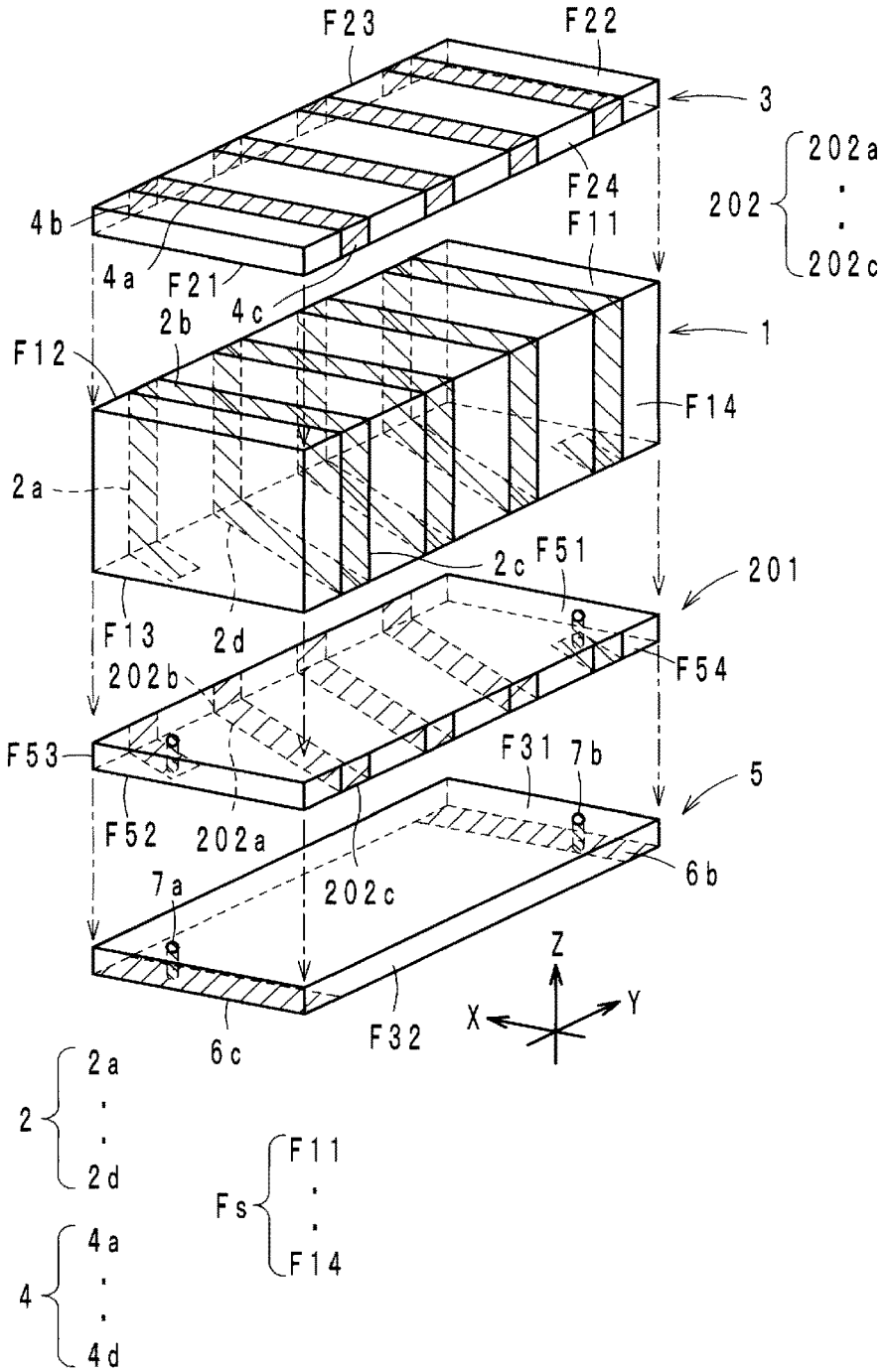
FIG. 14 is an exploded view of the coil antenna of FIG. 13.

In the first preferred embodiment described above, the second coil conductor 4 is preferably disposed on the first principal surface F11 of the magnetic core 1 with the first base material layer 3 interposed therebetween. However, the coil antenna is not limited to such a configuration, and it may further include, as illustrated in FIGS. 13 and 14, a third base material layer 201 and a fourth coil conductor 202 in addition to the configuration illustrated in FIGS. 1 and 2.

Preferably, the material and the size of the third base material layer 201 are the same as those of the first base material layer 3. The third base material layer 201 is stacked on the lower side of the second principal surface F13 of the magnetic core 1, and it has a joining surface F51, a third surface F52, a right lateral surface F53, and a left lateral surface F54, the right and left lateral surfaces F53 and F54 connecting the joining surface F51 and the third surface F52 to each other. The joining surface F51 and the third surface F52 are parallel or substantially parallel to the XY-plane and are opposed to each other in the up and down direction. The joining surface F51 is contacted with the second principal surface F13.

Preferably, the material and the line width of the fourth coil conductor 202 are the same as those of the second coil conductor 4. The fourth coil conductor 202 is constituted by conductor patterns 202*a* to 202*c*. The conductor pattern 202*a* is arranged on the third surface F52 to be parallel or substantially parallel to the conductor pattern 2*d* and to be overlapped with the conductor pattern 2*d* in a plan view when looking from the direction of a normal line with respect to the second principal surface F13. The conductor pattern 202*b* is located on the right lateral surface F53, and it connects one end of the conductor pattern 202*a* to the conductor pattern 2*a*. The conductor pattern 202*c* is located on the left lateral surface F54, and it connects the other end of the conductor pattern 202*a* to the conductor pattern 2*c*.

In this modification, the conductor pattern 2*d* is final one of the conductor patterns 2*a* to 2*d* in each turn. Taking, as a reference, one turn to which is connected the conductor pattern 202*c*, therefore, the conductor pattern 202*b* is connected to the conductor pattern 2*a* in a turn adjacent to the one turn. Furthermore, like the second coil conductor 4, the fourth coil conductor 202 is also provided corresponding to each turn of the first coil conductor 2.

Additionally, this modification is different from the first preferred embodiment in that the first insulator layer 5 is joined to the third surface F52 of the third base material layer 201.

According to the second modification, since the cross-sectional area of the current path can be significantly increased by an amount corresponding to a cross-sectional area of the fourth coil conductor 202 in comparison with the first preferred embodiment, the influence of a conductor loss is further reduced. Moreover, since the coil antenna of the second modification has stronger directivity in the direction of a normal line with respect to the third surface F52 in addition to the direction of the normal line with respect to the first surface F22, a sufficient communication distance is ensured in plural directions.

The second modification has been described above as adding the third base material layer 201 and the fourth coil conductor 202 to the first preferred embodiment. However, the configuration is not limited to such an example, and the third base material layer 201 and the fourth coil conductor 202 may be added to the first modification.

Third Modification of the First Preferred Embodiment

Figure 15:
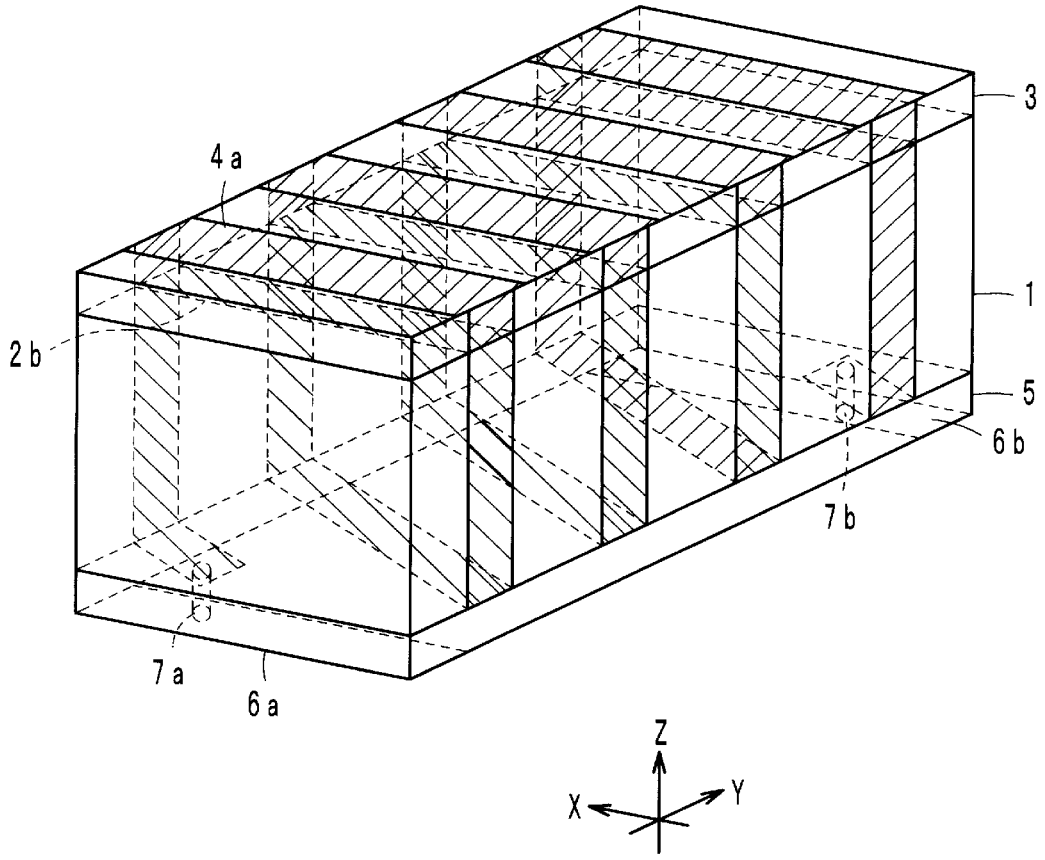
FIG. 15 is a perspective view of a coil antenna according to a third modification of a preferred embodiment of the present invention.
Figure 16:
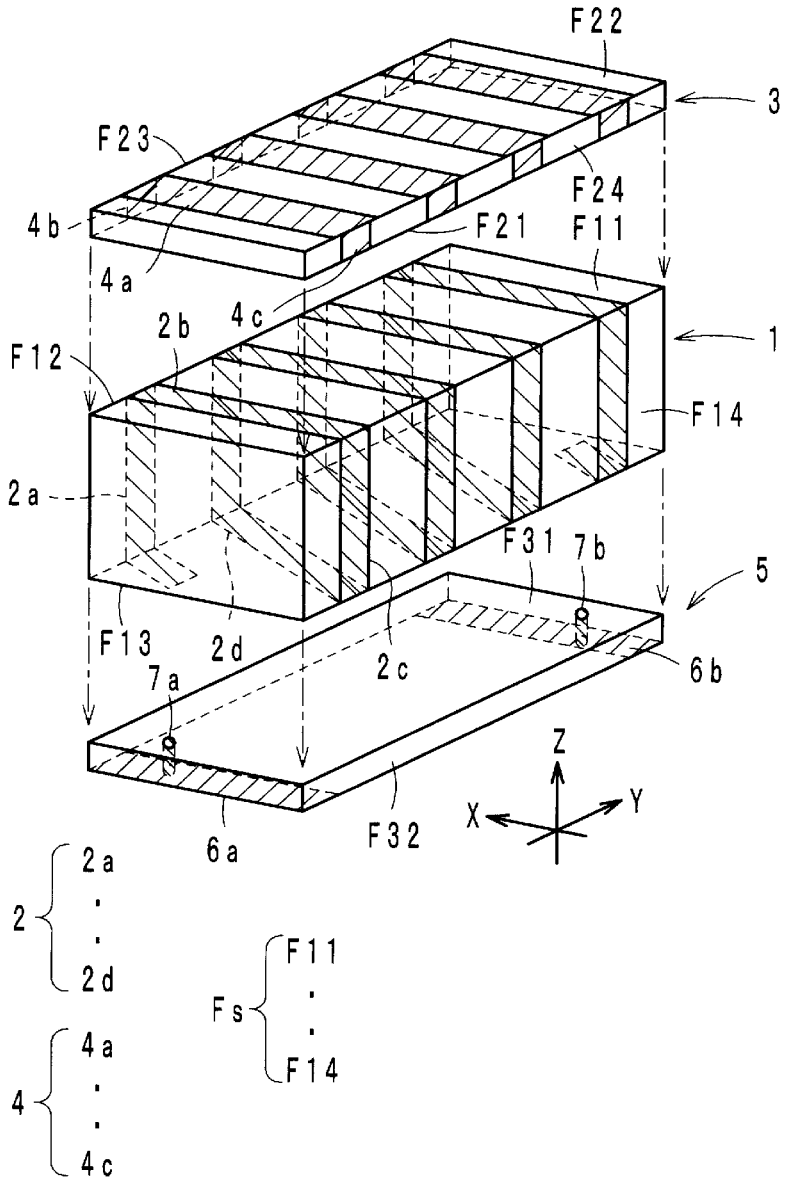
FIG. 16 is an exploded view of the coil antenna of FIG. 15.

In the first preferred embodiment described above, the line width of the conductor pattern 4*a* is the same as that of the conductor pattern 2*b*. However, the configuration is not limited to such an example. As illustrated in FIGS. 15 and 16, the line width of the conductor pattern 4*a* may be wider than that of the conductor pattern 2*b*. In that case, the influence of a conductor loss is further reduced in comparison with that in the first preferred embodiment. It is, however, needed to take care of that if the line width is too wide, the resonance frequency of the coil antenna would be reduced due to the interline capacitance between the adjacent conductor patterns 4*a*.

The third modification has been described with respect to the relation in line width between the conductor pattern 4*a* and the conductor pattern 2*b* in the first preferred embodiment. However, the configuration is not limited to such an example, and the line width of the third coil conductor 102 in the first modification or the line width of the fourth coil conductor 202 in the second modification may be set wider than that of the first coil conductor 2.

Fourth Modification of the First Preferred Embodiment

Figure 17:
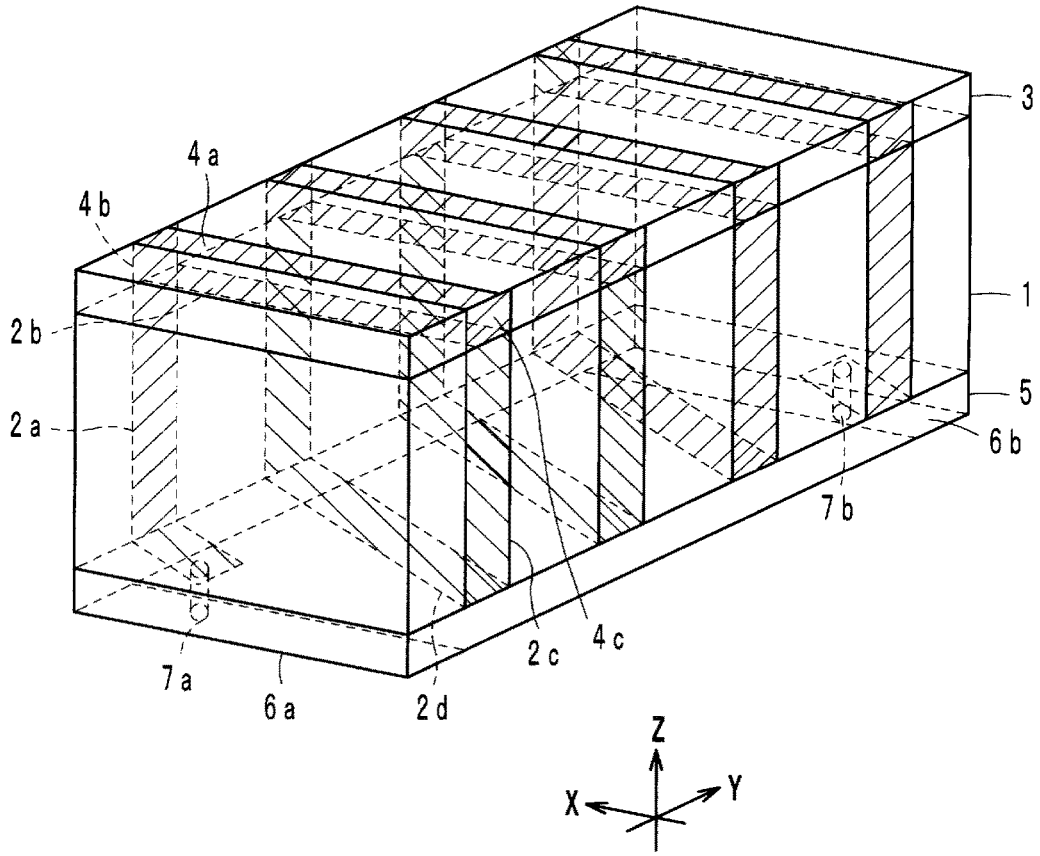
FIG. 17 is a perspective view of a coil antenna according to a fourth modification of a preferred embodiment of the present invention.
Figure 18:
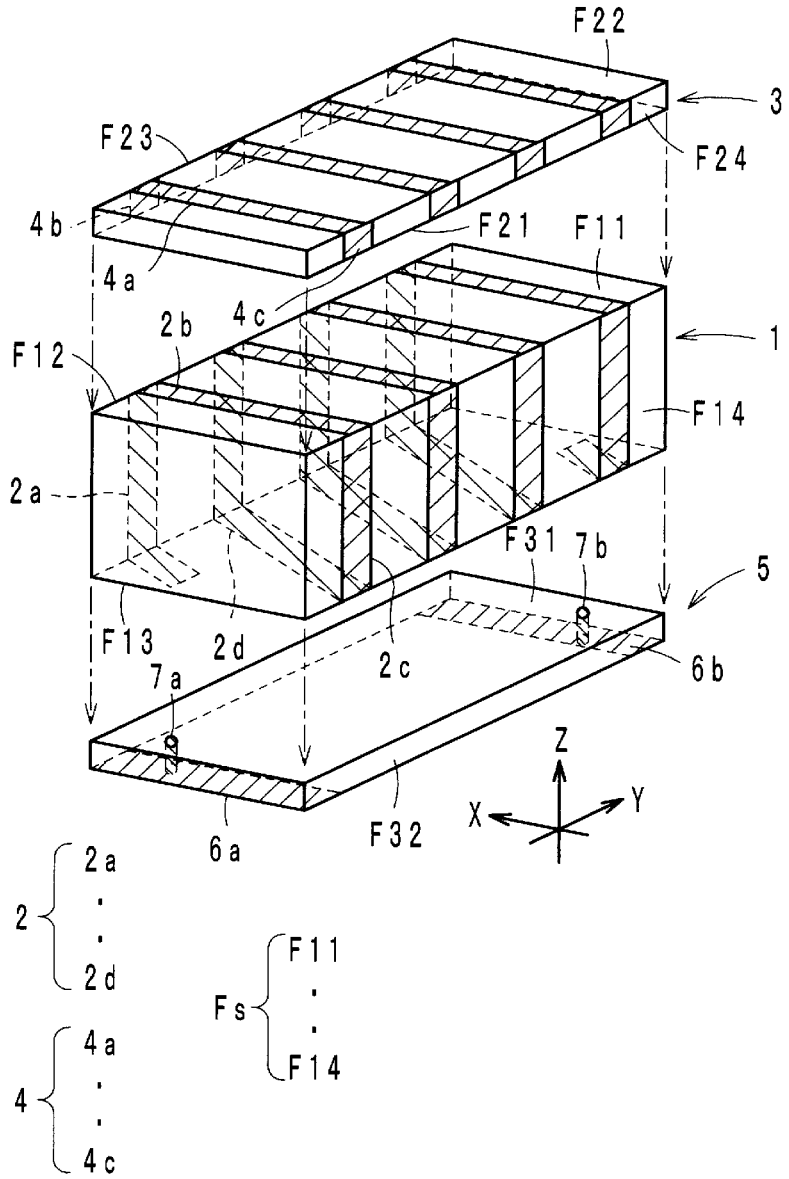
FIG. 18 is an exploded view of the coil antenna of FIG. 17.
Figure 19A:
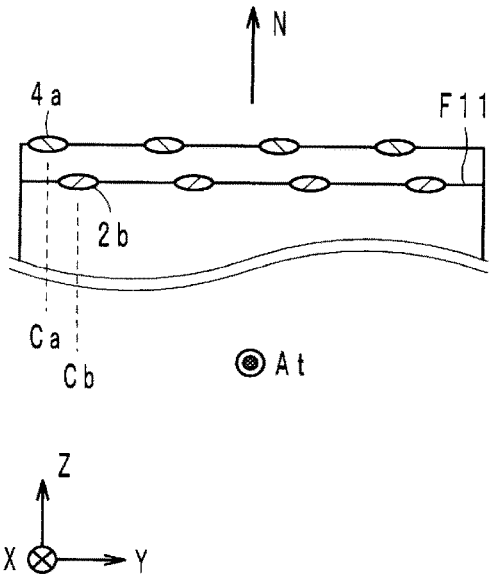
FIGS. 19A and 19B are schematic views to explain the effect of the coil antenna of FIG. 17.
Figure 19B:
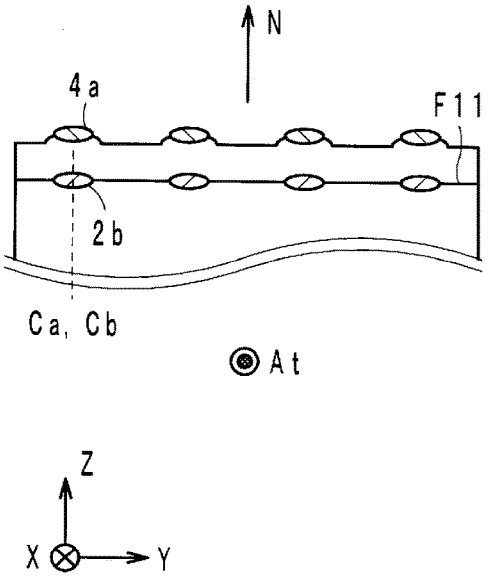

In the first preferred embodiment described above, the line widths of the conductor patterns 4*a* to 4*c* are the same, and the line widths of the conductor patterns 2*a* to 2*d* are the same. However, the configuration is not limited to such an example. As illustrated in FIGS. 17 and 18, the line width of the conductor pattern 4*a* may be narrower than that of the conductor patterns 4*b* and 4*c*, and the line width of the conductor pattern 2*b* may be narrower than that of the conductor patterns 2*a* and 2*c*. It is here assumed that, as illustrated in FIG. 19A, a line passing a center of the conductor pattern 4*a* in the direction of the winding axis At (i.e., in the Y-axis direction) is denoted by Ca, and a line passing a center of the conductor pattern 2*b* in the direction of the winding axis At (i.e., in the Y-axis direction) is denoted by Cb. The conductor patterns 4*a* and 2*b* are preferably arranged such that the centerlines Ca and Cb are not overlapped with each other in a plan view when looking from the direction of the normal line N with respect to the first principal surface F11. Such an arrangement increases the flatness of an upper surface of the coil antenna. The reason is as follows. The thicknesses of the conductor pattern 4*a* and 2*b* are actually not uniform and are maximized in respective portions corresponding to the centerlines Ca and Cb, as illustrated in FIG. 19B. Accordingly, if the centerlines Ca and Cb are overlapped with each other in the above-mentioned plan view, the flatness of the upper surface of the coil antenna would be poor.

The fourth modification has been described with respect to relative setting of the line width of each of the conductor pattern 4*a* and the conductor pattern 2*b* in the first preferred embodiment. However, the configuration is not limited to such an example, and the line widths of the third coil conductor 102 and the fourth coil conductor 202 may be set as in the fourth modification.

Fifth Modification of the First Preferred Embodiment

Figure 20:
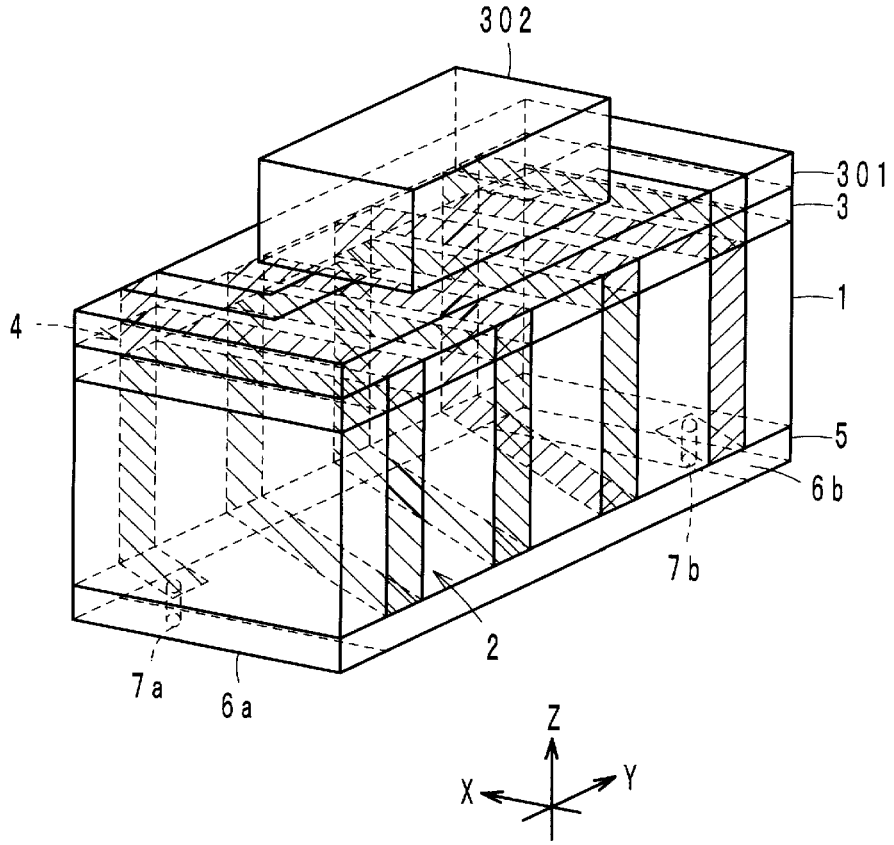
FIG. 20 is a perspective view of a coil antenna according to a fifth modification of a preferred embodiment of the present invention.
Figure 21:
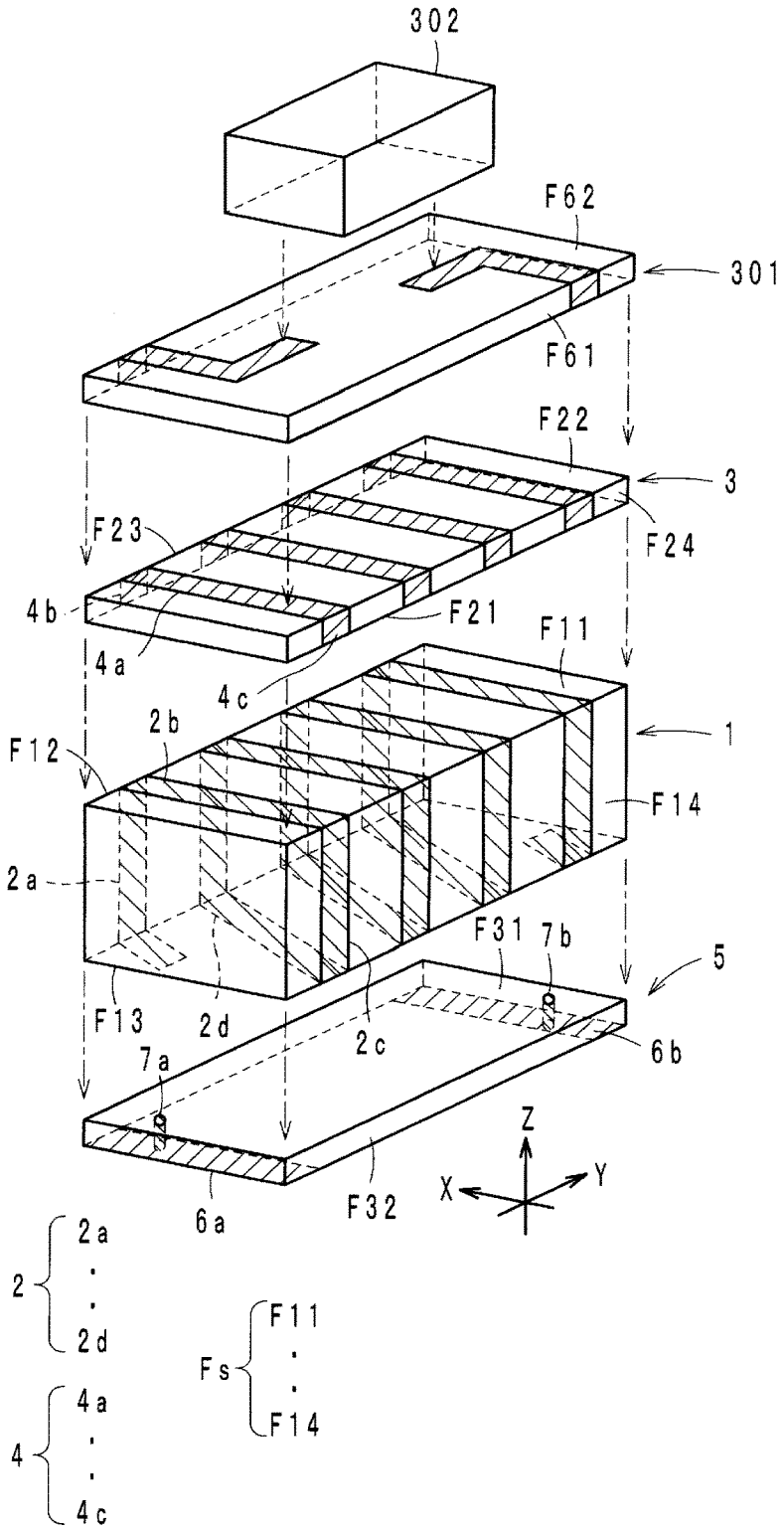
FIG. 21 is an exploded view of the coil antenna of FIG. 20.

In the first preferred embodiment described above, the second coil conductor 4 is disposed on the first principal surface F11 of the magnetic core 1 with the first base material layer 3 interposed therebetween. However, the configuration is not limited to such an example. As illustrated in FIGS. 20 and 21, the coil antenna may further include a second insulator layer 301, which is a typical example of an insulating layer, and an electronic component 302 in addition to the configuration illustrated in FIGS. 1 and 2.

Preferably, the material of the second insulator layer 301 is the same as that of the first insulator layer 5. The second insulator layer 301 is stacked, for example, on the first surface F22 of the first base material layer 3, and it includes at least a joining surface F61 and a mounting surface F62. The joining surface F61 and the mounting surface F62 are opposed to each other in the up and down direction. The joining surface F61 is joined to the first surface F22.

The electronic component 302 is, for example, a capacitor element, a resistance element, or an inductor element, and is mounted on the mounting surface F62. The electronic component 302 is coupled to, e.g., both ends of the first coil conductor 2. A capacitor element, a resistance element, or an inductor element, each including an electrode pattern, may be provided instead of the electronic component 302 on the mounting surface 62.

The fifth modification has been described above as additionally providing the second insulator layer 301 and the electronic component 302 in the first preferred embodiment. However, the configuration is not limited to such an example, and a similar second insulator layer and a similar electronic component may be additionally provided in the first to fourth modifications.

Sixth Modification of the First Preferred Embodiment

Figure 22:
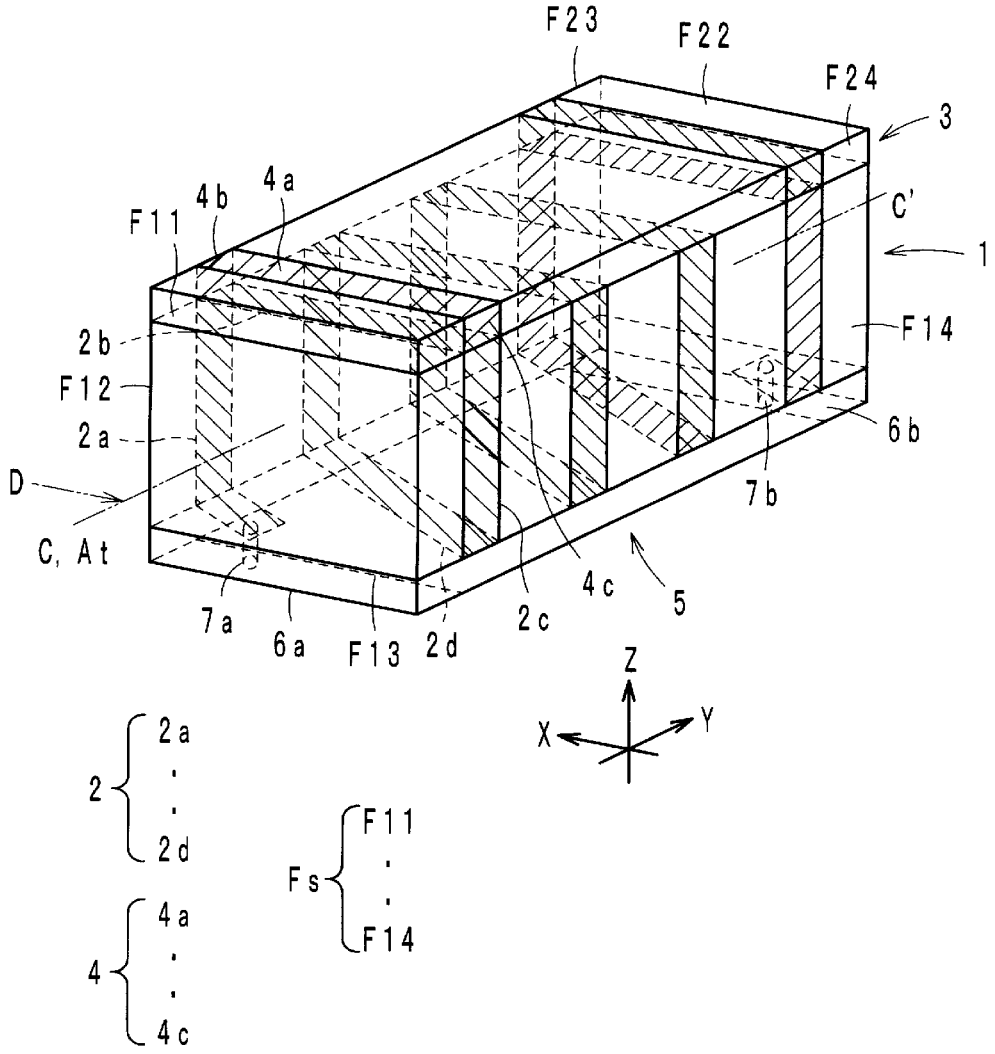
FIG. 22 is a perspective view of a coil antenna according to a sixth modification of a preferred embodiment of the present invention.
Figure 23:
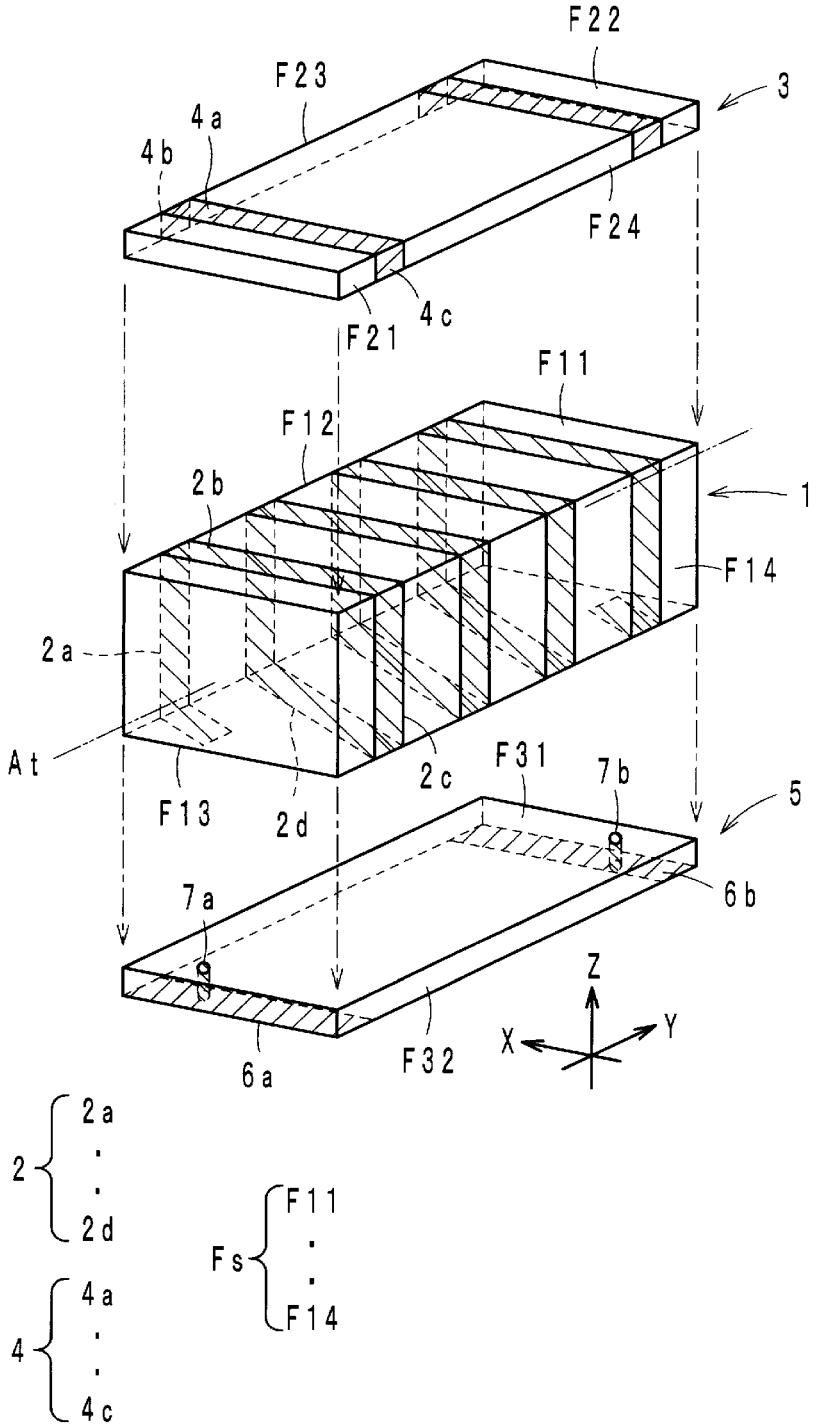
FIG. 23 is an exploded view of the coil antenna of FIG. 22.

In the first preferred embodiment described above, the conductor pattern 2*b* is preferably provided in a plural number on the first principal surface F11 of the magnetic core 1, and the conductor pattern 4*a* is preferably provided in a plural number on the first surface F22 of the first base material layer 3. The conductor patterns 4*a* are each overlapped with the corresponding conductor pattern 2*b* for each turn in the plan view when looking from the direction of the normal line with respect to the first principal surface F11. Stated in another way, the conductor pattern 4*a* and the conductor pattern 2*b* are positioned in one-to-one relation. However, the configuration is not limited to such an example. As illustrated in FIGS. 22 and 23, just two of the conductor pattern 4*a* may be provided on the first principal surface F22. More specifically, one of the two conductor patterns 4*a* is overlapped with one of the plural conductor patterns 2*b*, which is located at an end in the negative direction of the Y-axis, in the plan view when looking from the direction of the normal line with respect to the first principal surface F11, and it is electrically coupled to one end and the other end of the relevant conductor pattern 2*b*, which is formed at the end in the negative direction of the Y-axis, through the conductor patterns 4*b* and 4*c*, respectively. The other conductor pattern 4*a* is overlapped with another conductor pattern 2*b*, which is located at an end in the positive direction of the Y-axis, in the plan view when looking from the direction of the normal line with respect to the first principal surface F11, and it is electrically coupled to one end and the other end of the relevant conductor pattern 2*b*, which is located at the end in the positive direction of the Y-axis, through the conductor patterns 4*b* and 4*c*, respectively.

Figure 24:
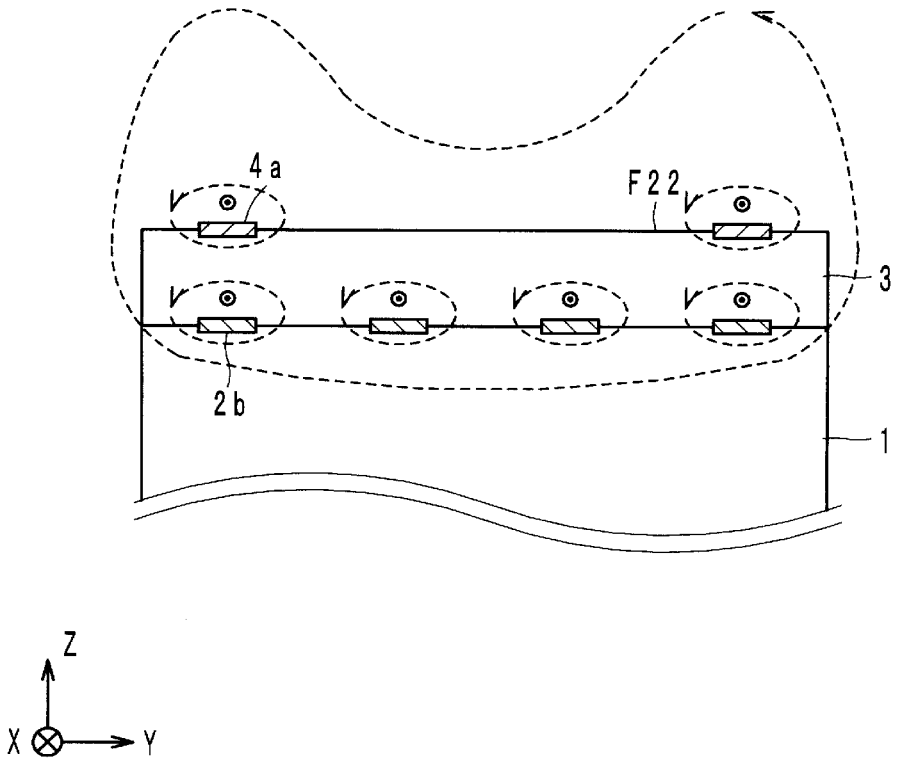
FIG. 24 is a longitudinal sectional view taken along a line C-C' in FIG. 22, looking at the section from the direction of an arrow D.

FIG. 24 illustrates a portion of a longitudinal section of the coil antenna on the positive direction side of the Z-axis, the section being taken along a line C-C' in FIG. 22. In FIG. 24, a dotted line represents one example of magnetic force lines defined by the coil antenna. In this modification, as described above, the two conductor patterns 4*a* are disposed at opposite end portions of the coil antenna in the Y-axis direction. Accordingly, when a current is supplied to the coil antenna, as illustrated in FIG. 24, the magnetic force lines spread to a relatively large extent in the positive direction of the Z-axis in the opposite end portions of the coil antenna in the Y-axis direction, while the magnetic force lines do not so spread in the positive direction of the Z-axis in a central portion of the coil antenna in the Y-axis direction. Stated in another way, the coil antenna has strong directivity in the positive direction of the Z-axis from the opposite end portions of the coil antenna in the Y-axis direction, and a sufficient communication distance can be ensured in those portions.

Seventh Modification of the First Preferred Embodiment

Figure 25:
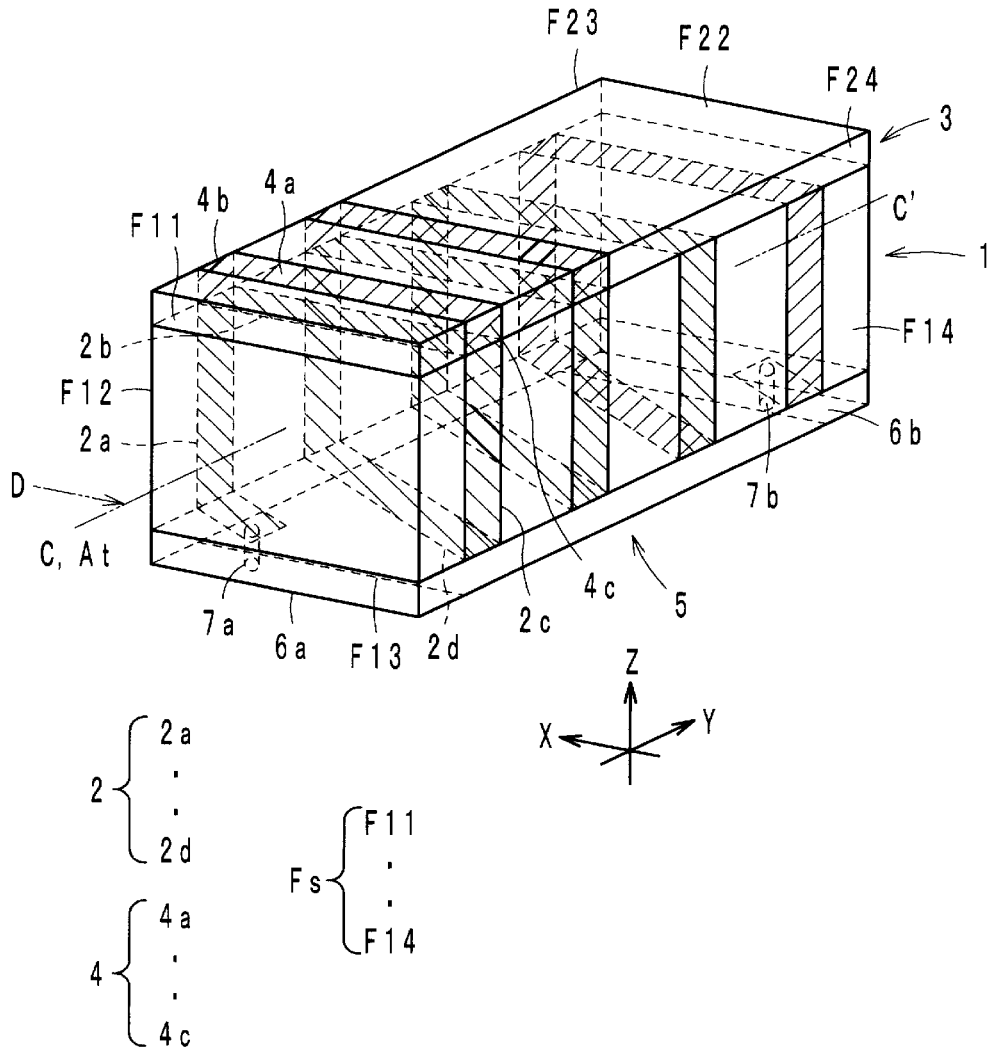
FIG. 25 is a perspective view of a coil antenna according to a seventh modification of a preferred embodiment of the present invention.
Figure 26:
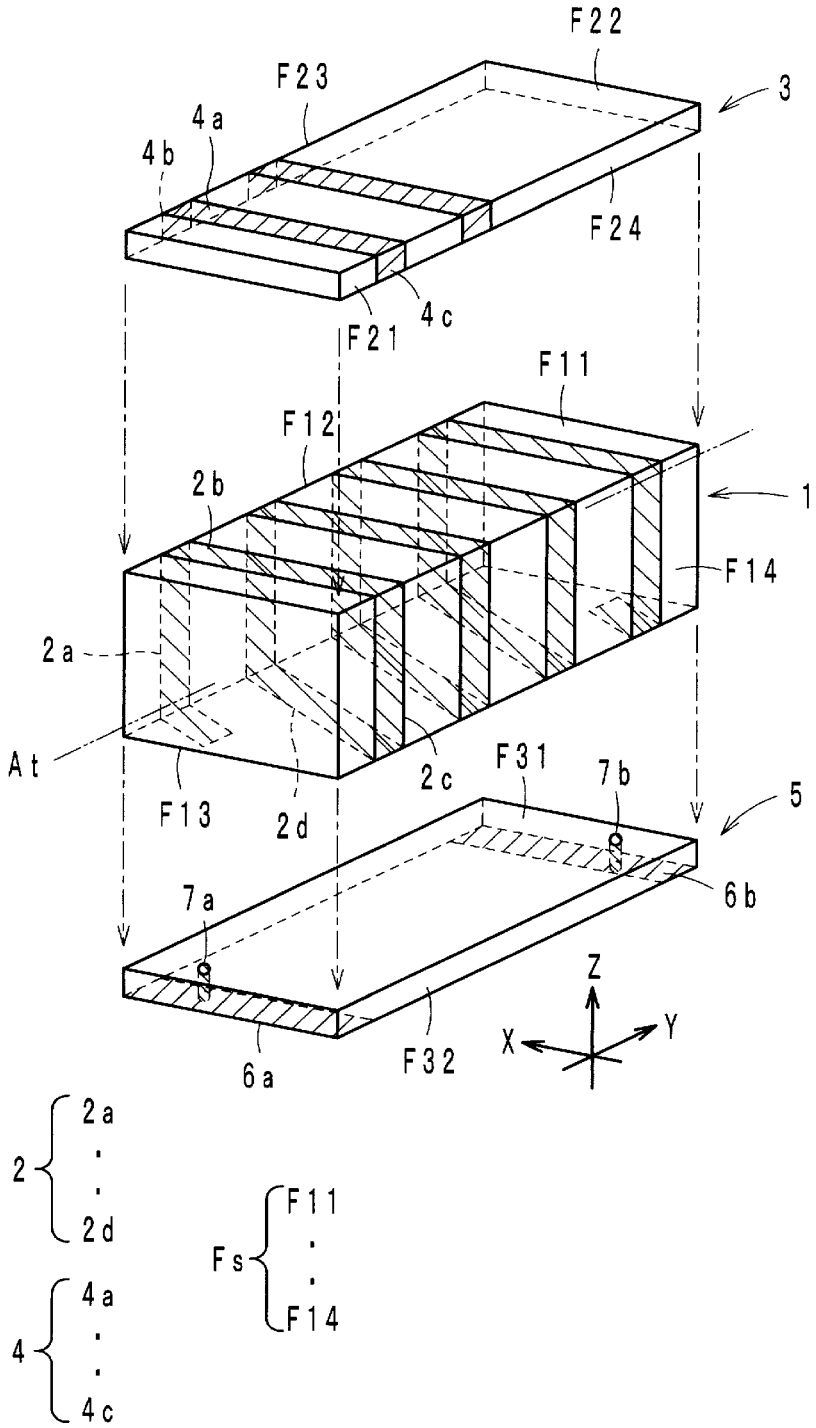
FIG. 26 is an exploded view of the coil antenna of FIG. 25.

In the sixth modification described above, the conductor patterns 4*a* are disposed at the opposite end portions of the coil antenna in the Y-axis direction. However, the configuration is not limited to such an example. As illustrated in FIGS. 25 and 26, two conductor patterns 4*a* may be provided on the negative direction side of the first principal surface F22 relative to a center thereof in the Y-axis direction. More specifically, one of the two conductor patterns 4*a* is overlapped with a conductor pattern 2*b*, which is located at an outermost end in the negative direction of the Y-axis, in the plan view when looking from the direction of the normal line with respect to the first principal surface F11, and it is electrically coupled to one end and the other end of the relevant conductor pattern 2*b* through the conductor patterns 4*b* and 4*c*, respectively. The other conductor pattern 4*a* is overlapped with another conductor pattern 2*b*, which is located at a second position from the end in the negative direction of the Y-axis, in the plan view when looking from the direction of the normal line with respect to the first principal surface F11, and it is electrically coupled to one end and the other end of the relevant conductor pattern 2*b* through the conductor patterns 4*b* and 4*c*, respectively.

Figure 27:
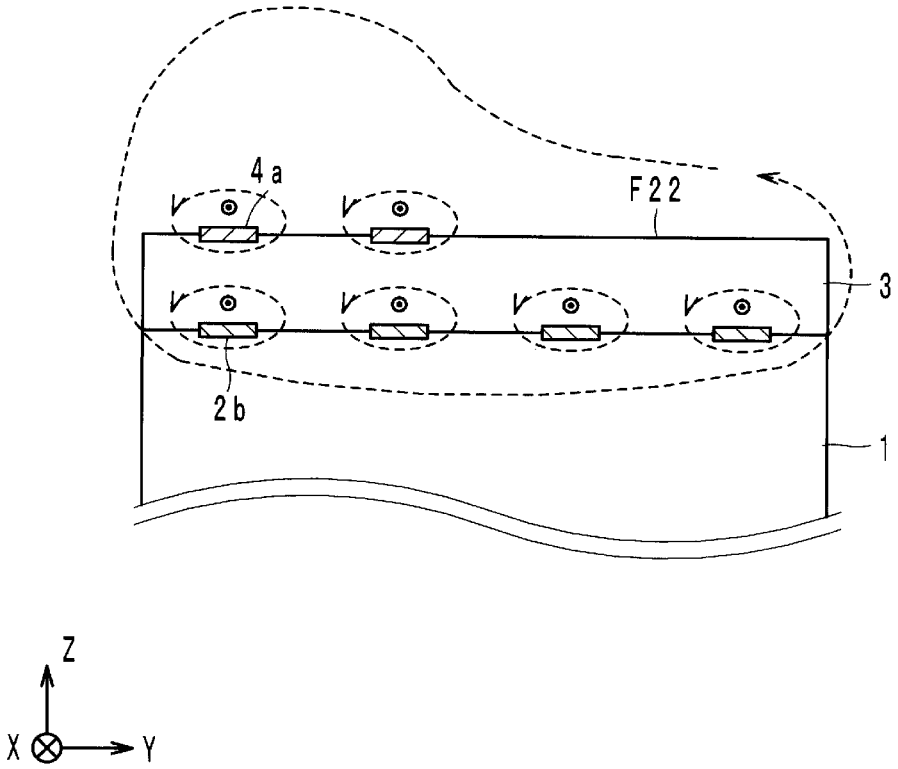
FIG. 27 is a longitudinal sectional view taken along a line C-C' in FIG. 25, looking at the section from the direction of an arrow D.

FIG. 27 illustrates a portion of a longitudinal section of the coil antenna on the positive direction side of the Z-axis, the section being taken along a line C-C' in FIG. 25. In FIG. 27, a dotted line represents one example of magnetic force lines generated by the coil antenna. In this modification, as described above, the two conductor patterns 4*a* are disposed at positions closer to the end of the coil antenna in the negative direction of the Y-axis. Accordingly, when a current is supplied to the coil antenna, as illustrated in FIG. 27, the generated magnetic force lines spread to a relatively large extent in the positive direction of the Z-axis in a portion of the coil antenna closer to the end in the negative direction of the Y-axis, while the magnetic force lines do not so spread in the positive direction of the Z-axis in a portion of the coil antenna closer to the end of the coil antenna in the positive direction of the Y-axis. Stated in another way, the coil antenna has strong directivity in the positive direction of the Z-axis away from the portion of the coil antenna closer to the end of the coil antenna in the negative direction of the Y-axis, and a sufficient communication distance is ensured in that portion.

Eighth Modification of the First Preferred Embodiment

Figure 28:
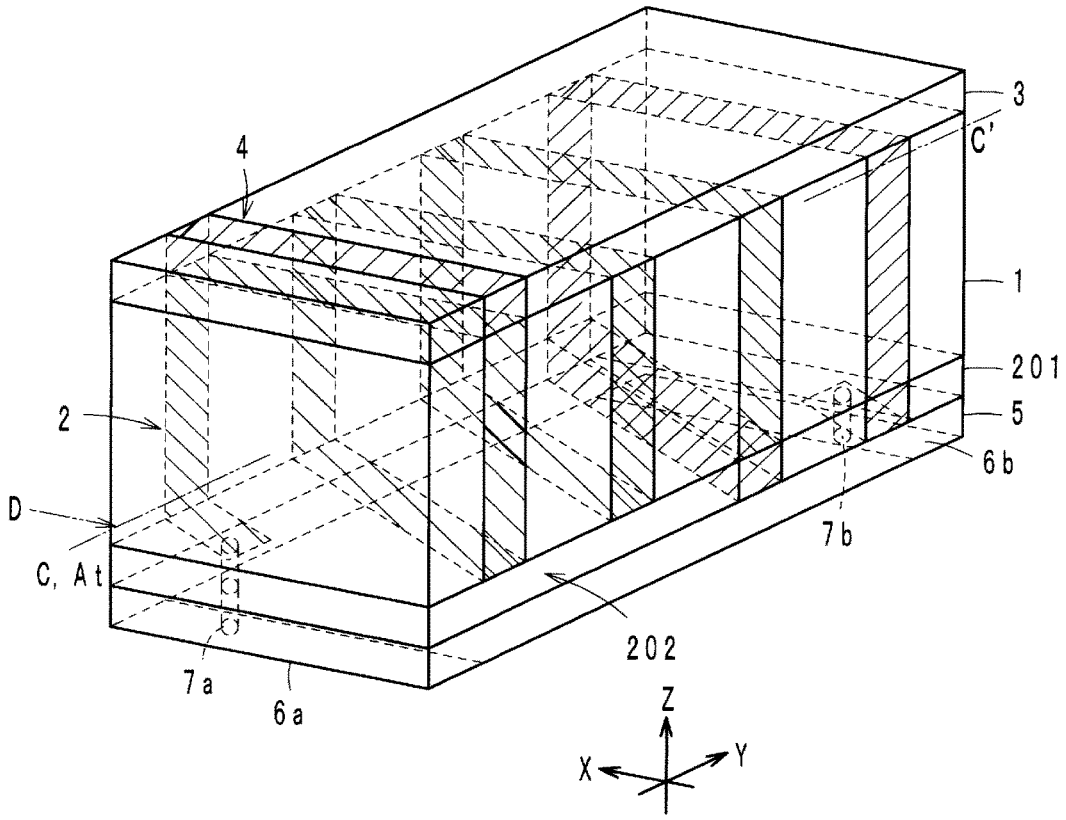
FIG. 28 is a perspective view of a coil antenna according to an eighth modification of a preferred embodiment of the present invention.
Figure 29:
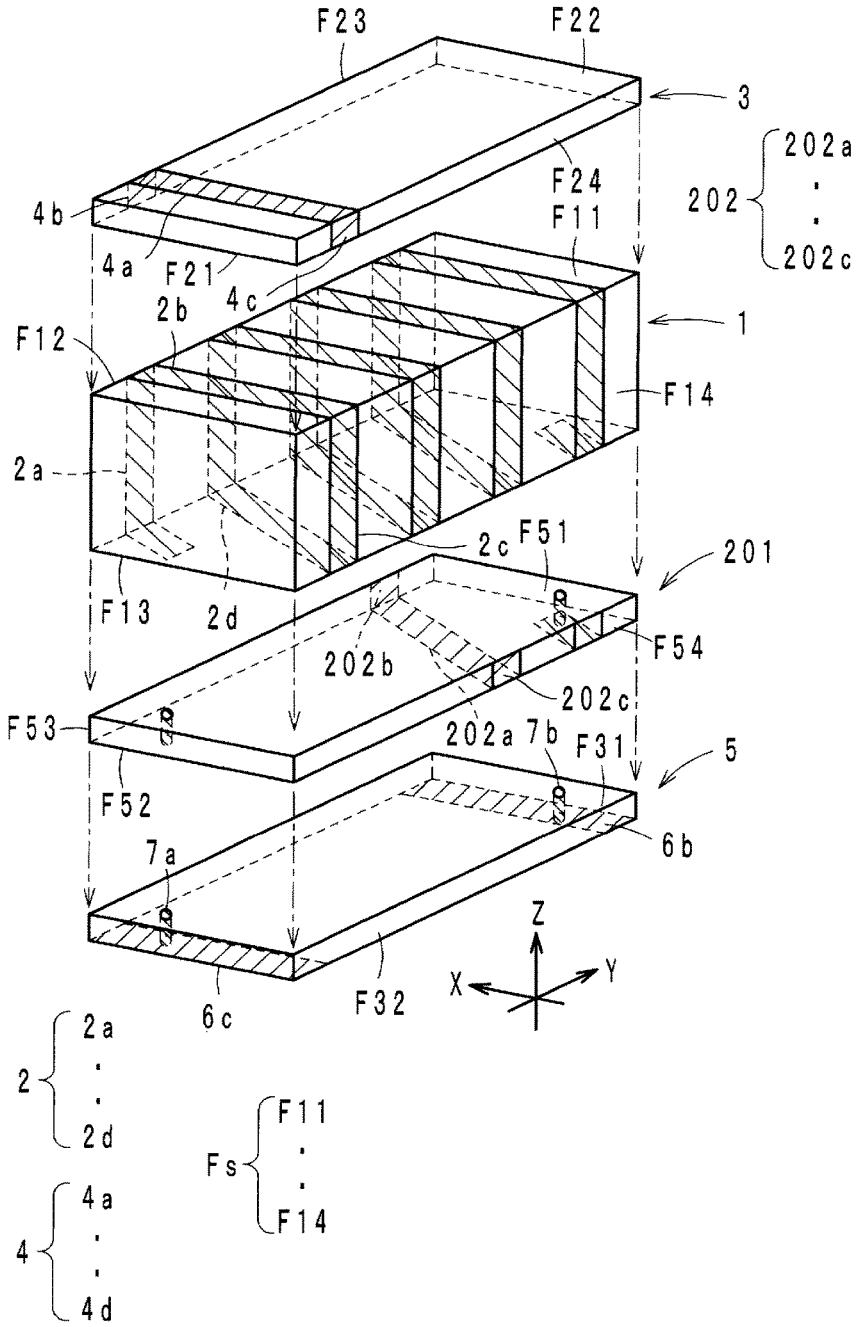
FIG. 29 is an exploded view of the coil antenna of FIG. 28.

In the second modification described above, the second coil conductor 4 is disposed on the first principal surface F11 of the magnetic core 1, and the fourth coil conductor 202 is disposed on the second principal surface F13. In that arrangement, the conductor patterns 4*a* included in the second coil conductor 4 are positioned in the one-to-one relation to the conductor patterns 2*b*, and the conductor patterns 202*a* included in the fourth coil conductor 202 are positioned in the one-to-one relation to the conductor patterns 2*d*. Here, the term "one-to-one relation" is as per explained in the sixth modification. However, the configuration is not limited to such an example. As illustrated in FIGS. 28 and 29, one conductor pattern 4*a*, for example, may be located on the first surface F22, and one conductor pattern 202*a*, for example, may be located on the third surface F52. More specifically, the above-mentioned one conductor pattern 4*a* is overlapped with the conductor pattern 2*b*, which is located at the end in the negative direction of the Y-axis, in the plan view when looking from the direction of the normal line with respect to the first principal surface F11, and it is electrically coupled to one end and the other end of the relevant conductor pattern 2*b* at the end in the negative direction of the Y-axis through the conductor patterns 4*b* and 4*c*, respectively. The above-mentioned one conductor pattern 202*a* is overlapped with the conductor pattern 2*d*, which is located at the end in the positive direction of the Y-axis, in the plan view when looking from the direction of the normal line with respect to the second principal surface F13, and it is electrically coupled to one end and the other end of the relevant conductor pattern 2*d* through the conductor patterns 202*b* and 202*c*, respectively.

Figure 30:
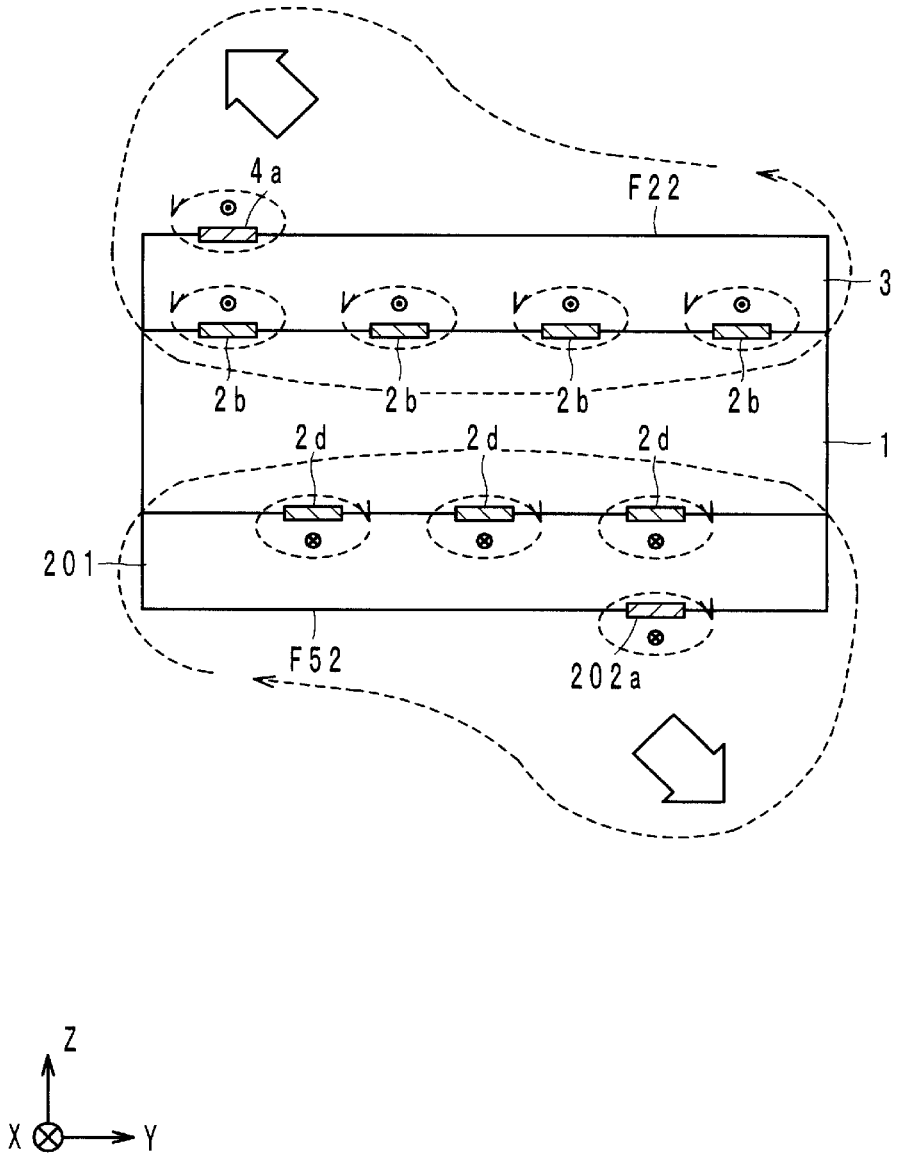
FIG. 30 is a longitudinal sectional view taken along a line C-C' in FIG. 28, looking at the section from the direction of an arrow D.

FIG. 30 illustrates a longitudinal section of the coil antenna taken along a line C-C' in FIG. 28. In FIG. 30, dotted lines represent one example of magnetic force lines generated on the positive direction side of the Z-axis and one example of magnetic force lines generated on the negative direction side of the Z-axis with the coil antenna being a reference. In this modification, as described above, the conductor pattern 4*a* is disposed at the end of the coil antenna in the negative direction of the Y-axis, and the conductor pattern 202*a* is disposed at the end of the coil antenna in the positive direction of the Y-axis. Accordingly, when a current is supplied to the coil antenna, as illustrated in FIG. 30, the magnetic force lines generated on the positive direction side of the Z-axis spread in the positive direction of the Z-axis to a relatively large extent in the end portion of the coil antenna in the negative direction of the Y-axis. Furthermore, as illustrated in FIG. 30, the magnetic force lines generated on the negative direction side of the Z-axis spread in the negative direction of the Z-axis to a relatively large extent in the end portion of the coil antenna in the positive direction of the Y-axis. Stated in another way, the coil antenna has strong directivity in the direction interconnecting the conductor patterns 4*a* and 202*a*, and a sufficient communication distance is ensured in that direction.

Ninth Modification of the First Preferred Embodiment

Figure 31:
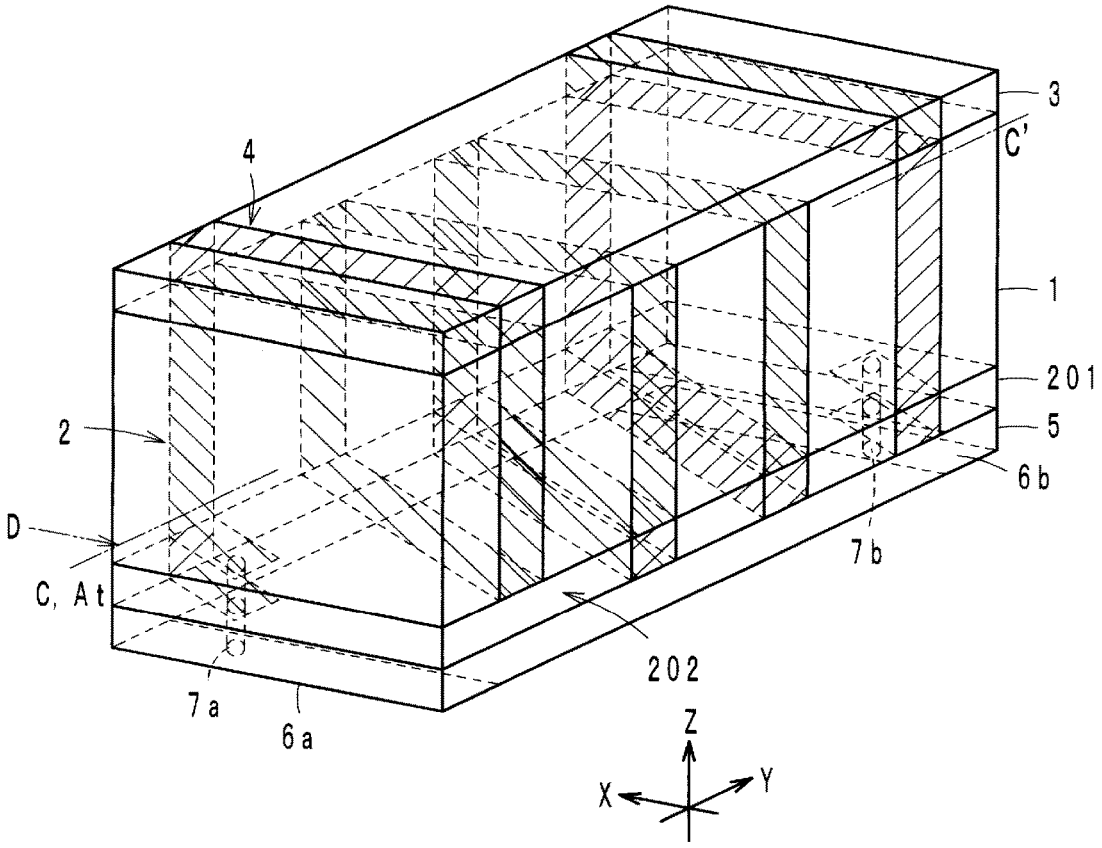
FIG. 31 is a perspective view of a coil antenna according to a ninth modification of a preferred embodiment of the present invention.
Figure 32:
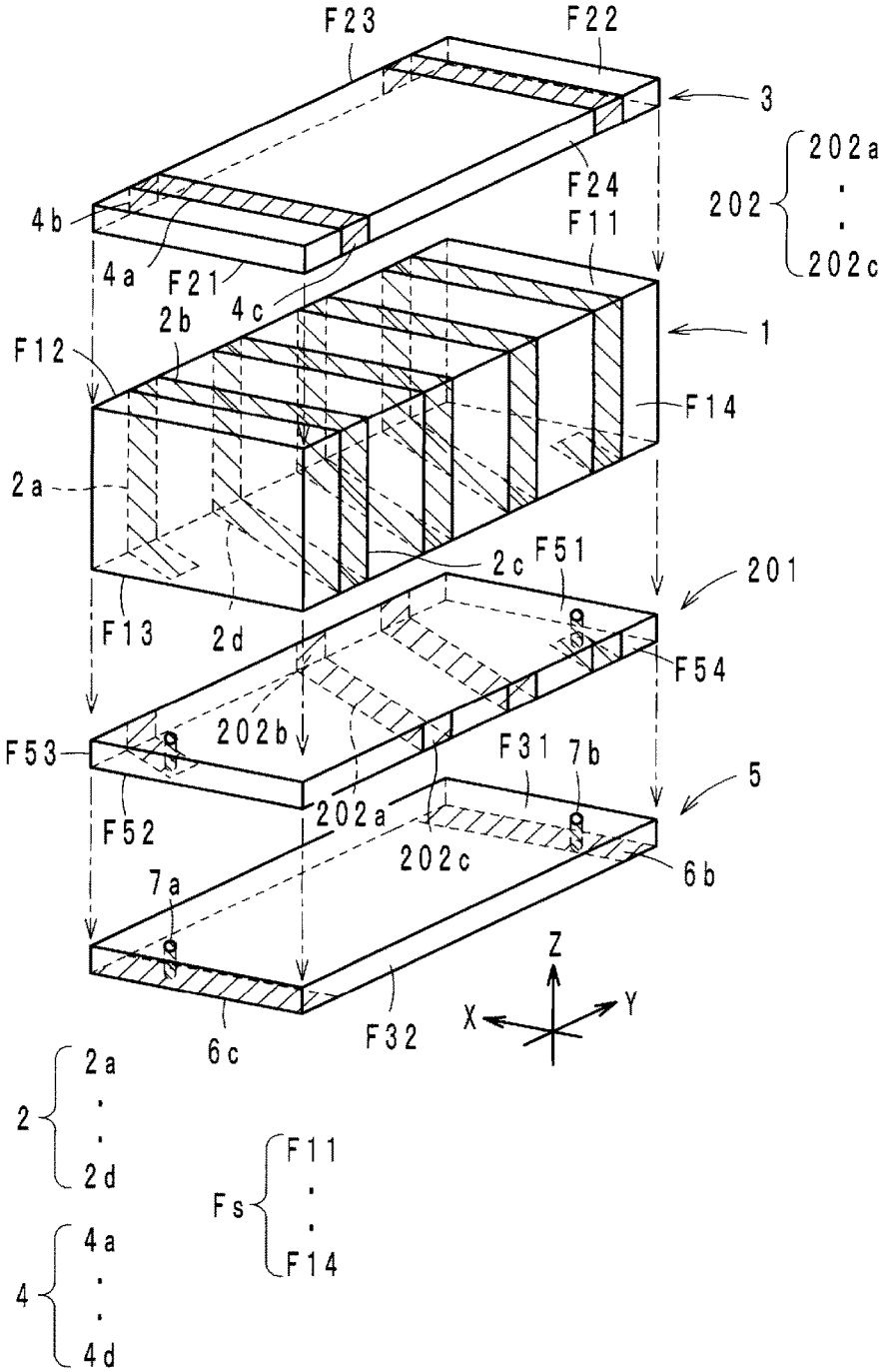
FIG. 32 is an exploded view of the coil antenna of FIG. 31.

In the second modification described above, the second coil conductor 4 is disposed on the first principal surface F11 of the magnetic core 1, and the fourth coil conductor 202 is disposed on the second principal surface F13. In that arrangement, the conductor patterns 4*a* included in the second coil conductor 4 are positioned in the one-to-one relation (described above) to the conductor patterns 2*b*, and the conductor patterns 202*a* included in the fourth coil conductor 202 are positioned in the one-to-one relation to the conductor patterns 2*d*. However, the configuration is not limited to such an example. As illustrated in FIGS. 31 and 32, two conductor patterns 4*a*, for example, may be provided on the first surface F22, and two conductor patterns 202*a*, for example, may be provided on the third surface F52.

More specifically, one of the two conductor patterns 4*a* is overlapped with the conductor pattern 2*b*, which is located at the end in the negative direction of the Y-axis, in the plan view when looking from the direction of the normal line with respect to the first principal surface F11, and it is electrically coupled to one end and the other end of the relevant conductor pattern 2*b* through the conductor patterns 4*b* and 4*c*, respectively. The other conductor pattern 4*a* is overlapped with the conductor pattern 2*b*, which is located at the end in the positive direction of the Y-axis, in the plan view when looking from the direction of the normal line with respect to the first principal surface F11, and it is electrically coupled to one end and the other end of the relevant conductor pattern 2*b* through the conductor patterns 4*b* and 4*c*, respectively.

Moreover, one of the two conductor patterns 202*a* is overlapped with the conductor pattern 2*d*, which is located at the end in the positive direction of the Y-axis, in the plan view when looking from the direction of the normal line with respect to the second principal surface F13, and it is electrically coupled to one end and the other end of the relevant conductor pattern 2*d* through the conductor patterns 4*b* and 4*c*, respectively. The other conductor pattern 202*a* is overlapped with the conductor pattern 2*d*, which is located at a second position from the end in the positive direction of the Y-axis, in the plan view when looking from the direction of the normal line with respect to the second principal surface F13, and it is electrically coupled to one end and the other end of the relevant conductor pattern 2*d* through the conductor patterns 4*b* and 4*c*, respectively.

Figure 33:
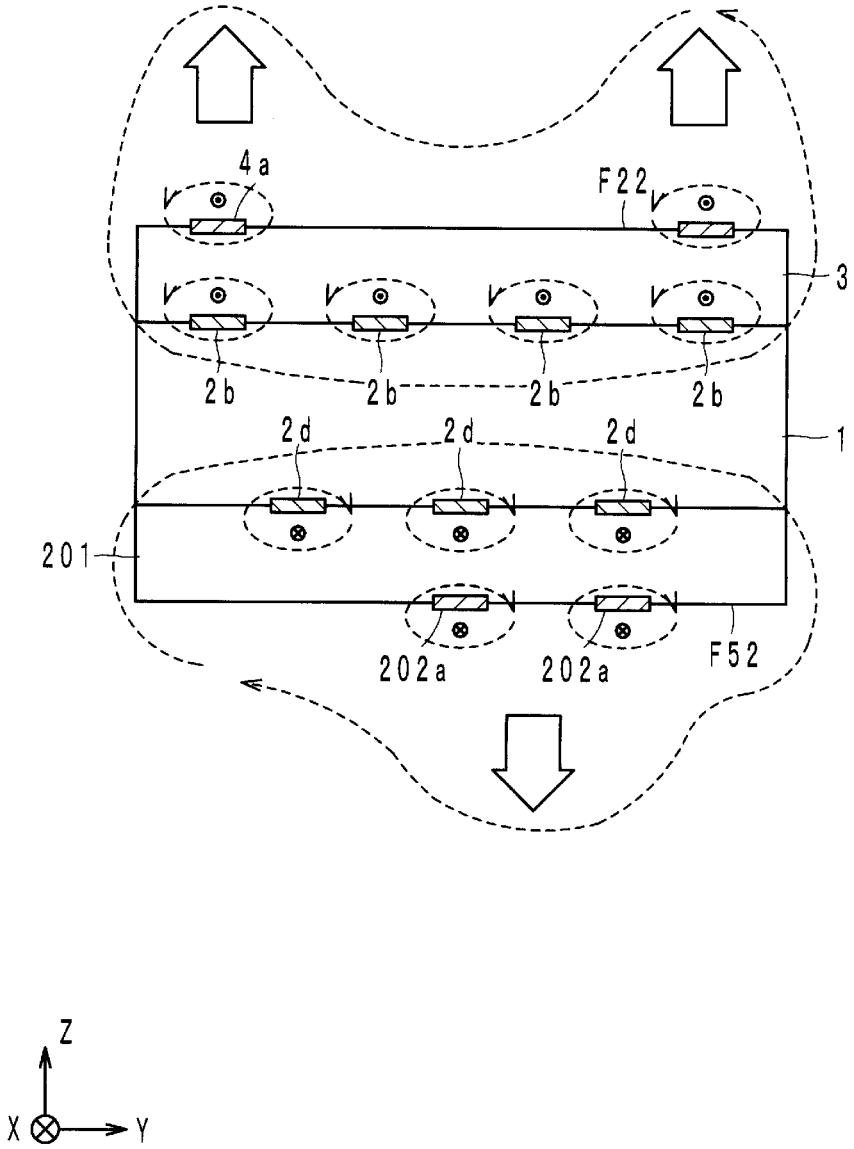
FIG. 33 is a longitudinal sectional view taken along a line C-C' in FIG. 31, looking at the section from the direction of an arrow D.

FIG. 33 illustrates a longitudinal section of the coil antenna taken along a line C-C' in FIG. 31. In FIG. 33, dotted lines represent one example of magnetic force lines generated on the positive direction side of the Z-axis and one example of magnetic force lines generated on the negative direction side of the Z-axis with the coil antenna being a reference. In this modification, as described above, the conductor patterns 4*a* are disposed in both the end portions of the coil antenna in the positive and negative directions of the Y-axis, and the conductor patterns 202*a* are disposed in a portion of the coil antenna closer to the end in the positive direction of the Y-axis. Accordingly, when a current is supplied to the coil antenna, as illustrated in FIG. 33, the magnetic force lines generated on the positive direction side of the Z-axis spread in the positive direction of the Z-axis to a relatively large extent in both the end portions of the coil antenna in the Y-axis direction. Furthermore, as illustrated in FIG. 33, the magnetic force lines generated on the negative direction side of the Z-axis spread in the negative direction of the Z-axis to a relatively large extent in the portion of the coil antenna closer to the end in the positive direction of the Y-axis. Stated in another way, the coil antenna has strong directivity in the positive direction of the Z-axis in both the end portions of the coil antenna in the Y-axis direction, and in the negative direction of the Z-axis in the portion of the coil antenna closer to the end in the positive direction of the Y-axis. Hence a sufficient communication distance is ensured in those portions.

Tenth Modification of the First Preferred Embodiment

Figure 34:
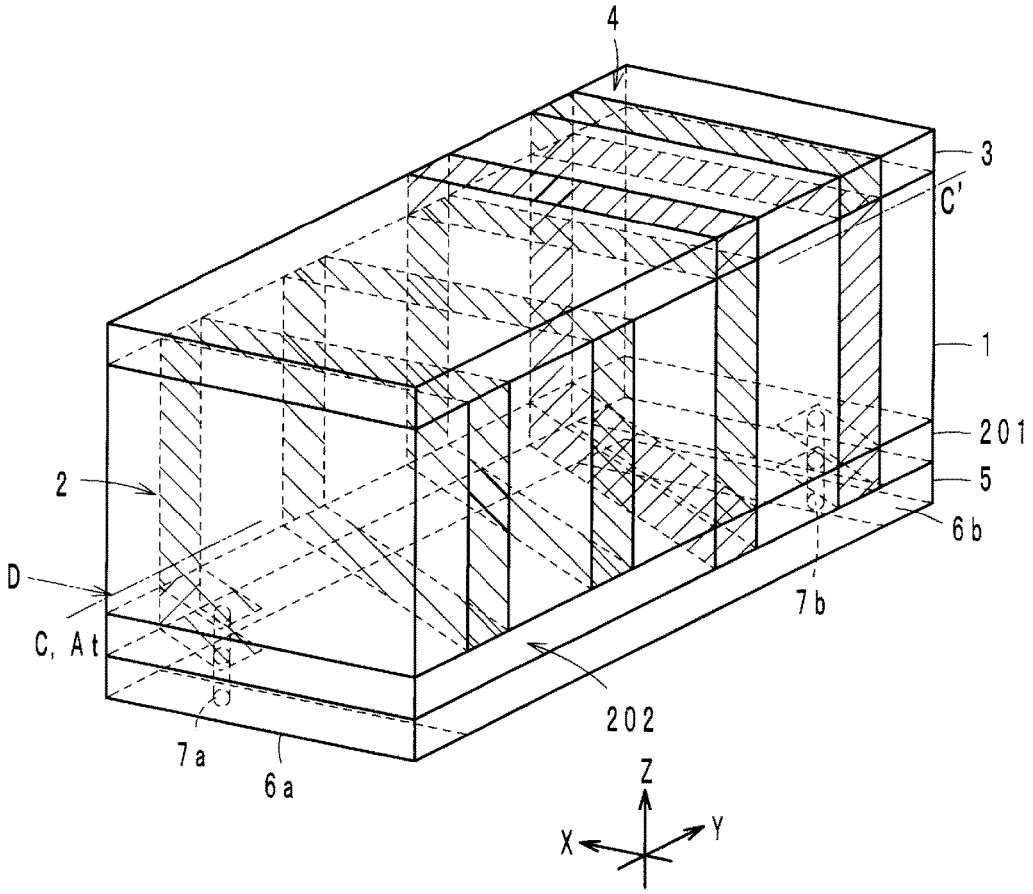
FIG. 34 is a perspective view of a coil antenna according to a tenth modification of a preferred embodiment of the present invention.
Figure 35:
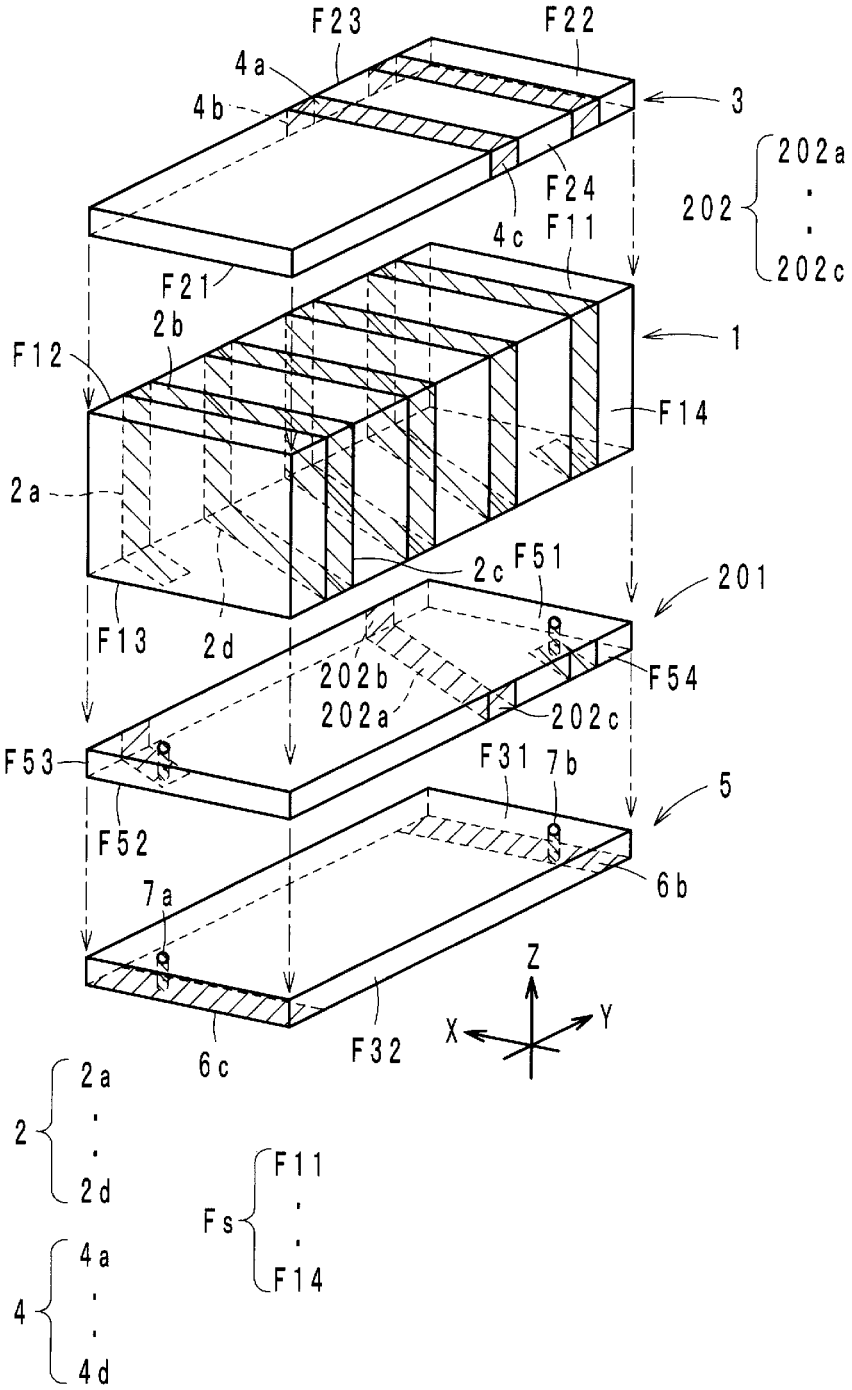
FIG. 35 is an exploded view of the coil antenna of FIG. 34.

In the second modification described above, the second coil conductor 4 is disposed on the first principal surface F11 of the magnetic core 1, and the fourth coil conductor 202 is disposed on the second principal surface F13. In that arrangement, the conductor patterns 4*a* included in the second coil conductor 4 are positioned in the one-to-one relation (described above) to the conductor patterns 2*b*, and the conductor patterns 202*a* included in the fourth coil conductor 202 are positioned in the one-to-one relation to the conductor patterns 2*d*. However, the configuration is not limited to such an example. As illustrated in FIGS. 34 and 35, two conductor patterns 4*a*, for example, may be located on the first surface F22, and one conductor pattern 202*a*, for example, may be located on the third surface F52.

More specifically, one of the two conductor patterns 4*a* is overlapped with the conductor pattern 2*b*, which is located at the end in the positive direction of the Y-axis, in the plan view when looking from the direction of the normal line with respect to the first principal surface F11, and it is electrically coupled to one end and the other end of the relevant conductor pattern 2*b* through the conductor patterns 4*b* and 4*c*, respectively. The other conductor pattern 4*a* is overlapped with the conductor pattern 2*b*, which is located at the second position from the end in the positive direction of the Y-axis, in the plan view when looking from the direction of the normal line with respect to the first principal surface F11, and it is electrically coupled to one end and the other end of the relevant conductor pattern 2*b* through the conductor patterns 4*b* and 4*c*, respectively.

Moreover, the above-mentioned one conductor pattern 202*a* is overlapped with the conductor pattern 2*d*, which is located at the end in the positive direction of the Y-axis, in the plan view when looking from the direction of the normal line with respect to the second principal surface F13, and it is electrically coupled to one end and the other end of the relevant conductor pattern 2*d* through the conductor patterns 202*b* and 202*c*, respectively.

Figure 36:
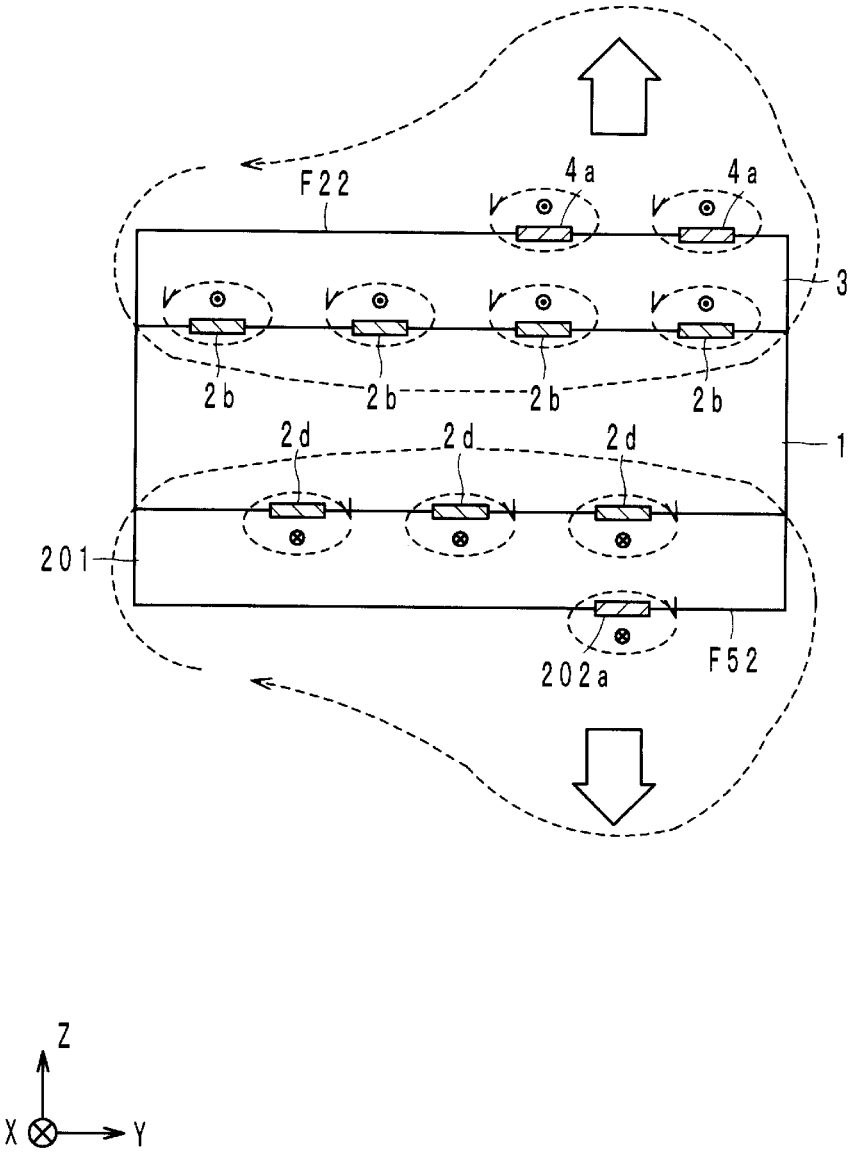
FIG. 36 is a longitudinal sectional view taken along a line C-C' in FIG. 35, looking at the section from the direction of an arrow D.

FIG. 36 illustrates a longitudinal section of the coil antenna taken along a line C-C' in FIG. 34. In FIG. 36, dotted lines represent one example of magnetic force lines generated on the positive direction side of the Z-axis and one example of magnetic force lines generated on the negative direction side of the Z-axis with the coil antenna being a reference. In this modification, as described above, the conductor patterns 4*a* are disposed in a portion of the coil antenna closer to the end in the positive direction of the Y-axis, and the conductor pattern 202*a* is disposed in an end portion of the coil antenna in the positive direction of the Y-axis. Accordingly, when a current is supplied to the coil antenna, as illustrated in FIG. 36, the magnetic force lines generated on the positive direction side of the Z-axis spread in the positive direction of the Z-axis to a relatively large extent in the portion of the coil antenna closer to the end in the positive direction of the Y-axis. Furthermore, as illustrated in FIG. 36, the magnetic force lines generated on the negative direction side of the Z-axis spread in the negative direction of the Z-axis to a relatively large extent in the end portion of the coil antenna in the Y-axis direction. Stated in another way, the coil antenna has strong directivity in the positive and negative directions of the Z-axis in the portions of the coil antenna closer to the end in the positive direction of the Y-axis, and a sufficient communication distance is ensured in that portion.

Eleventh Modification of the First Preferred Embodiment

Figure 37:
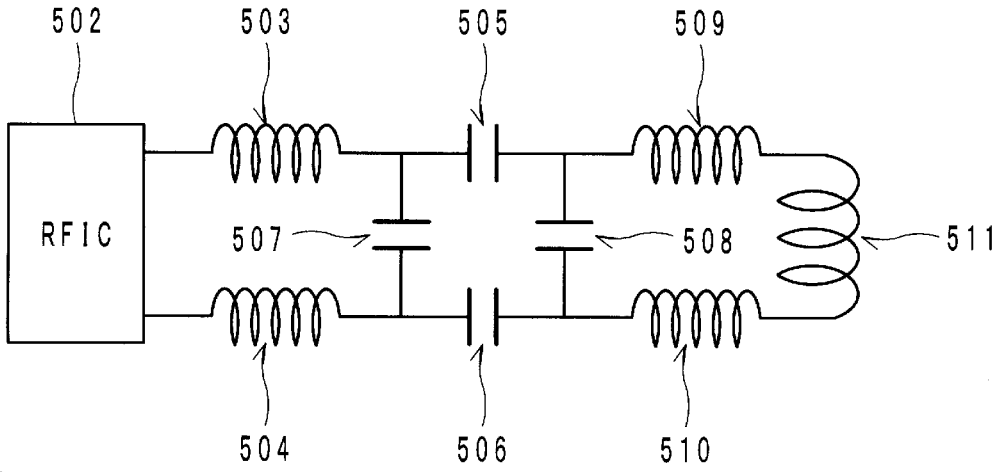
FIG. 37 is an equivalent circuit diagram of a module that performs non-contact communication.
Figure 38:
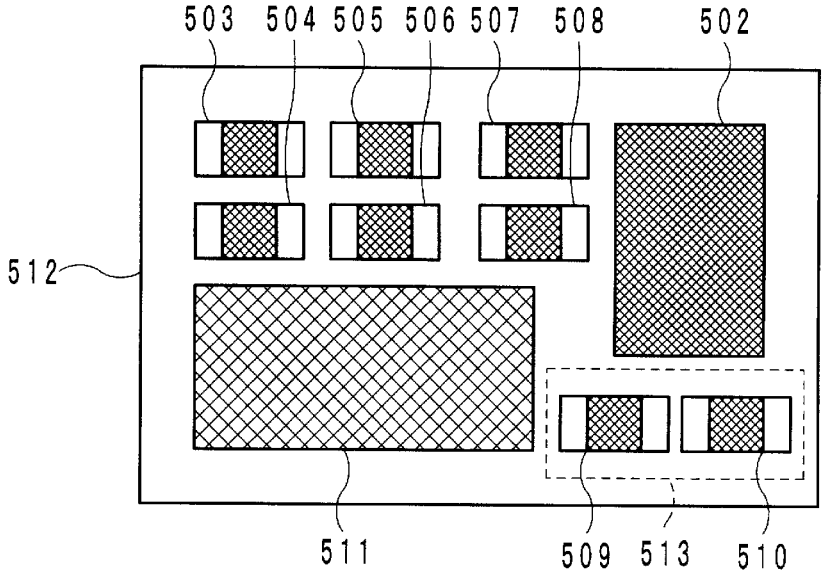
FIG. 38 illustrates a detailed configuration of the module of FIG. 37.

As described above, the coil antennas according to the preferred embodiment and the modifications are preferably used in non-contact communication based on NFC (Near Field Communication) in a band of 13.56 MHz, for example. FIG. 37 is an equivalent circuit diagram of a module that performs non-contact communication. FIG. 38 illustrates a detailed configuration of the module of FIG. 37. In FIGS. 37 and 38, the module includes, on a substrate 512, an RFIC chip 502, a matching circuit including inductances 503 and 504 and capacitors 505 to 507, and a resonance circuit including a capacitor 508, inductances 509 and 510, and a coil antenna 511. The resonance circuit causes resonation with a high-frequency signal supplied from the RFIC chip 502. Here, a resonance frequency is determined depending on an L value of the coil antenna 511, respective L values of the inductances 509 and 510, and a capacitance of the capacitor 508. The matching circuit is disposed between the RFIC chip 502 and the resonance circuit to establish impedance matching therebetween.

In general, correlation exists between a size of the coil antennal 511 and a communication distance of the module. Accordingly, there is a demand for increasing the size of the coil antenna 511 in order to ensure a satisfactory communication distance. With a tendency toward further reduction of, e.g., the size and the thickness of a radio communication device on which the module is to be mounted, however, it has been difficult to secure a sufficient mounting space for the module. Furthermore, in the preferred embodiments and the modifications described above, the coil antenna 511 includes a magnetic core to obtain a large L value. Because the magnetic core is made of a hard and fragile material in some cases, the shape of the magnetic core is restricted from the viewpoint of reliability. This implies that there is a difficulty in realizing an application to radio communication devices, having even smaller sizes and thicknesses, with an improvement of the coil antenna 511 alone. In view of such a point, in this modification, the inductances 509 and 510 coupled in series to the coil antenna 511 are mounted in a vacant space 513 on the substrate 512 such that the L value of the module is increased in the entirety of the module. It is to be noted that the inductances 509 and 510 may be chip inductances as illustrated in the drawing, but they may also be in the form of a meander pattern or a spiral electrode.

The antenna device according to preferred embodiments of the present invention and modifications thereof are able to ensure a sufficient communication distance while suppressing a conductor loss. The antenna device is suitably applied to communication terminal devices used in NFC (Near Field Communication) and FeliCa, for example, and to small-sized radios, such as a small-sized radio mainly used at frequencies of the VHF band or lower.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A coil antenna comprising:

a core including a peripheral surface including at least a first principal surface;

a first coil conductor located on the first principal surface and wound around a predetermined winding axis;

a first base material layer stacked on the first principal surface, including at least a first surface parallel or substantially parallel to the first principal surface; and a second coil conductor located on at least the first surface; wherein the second coil conductor is coupled to the first coil conductor on the first principal surface at least at two points so that the second coil conductor and the first coil conductor make a parallel circuit connection; and the predetermined winding axis of the first coil conductor extends in a direction that is parallel or substantially parallel to the first principal surface of the core.

2. The coil antenna according to claim 1, wherein the core is a multilayer body comprising a plurality of layers.

3. The coil antenna according to claim 1, further comprising:

a second base material layer stacked on the first surface, including at least a second surface parallel or substantially parallel to the first principal surface; and a third coil conductor located on at least the second surface; wherein opposite ends of the third coil conductor are coupled to the second coil conductor on the first surface; and the direction in which a current flows through the first coil conductor on the first principal surface is the same or substantially the same as a direction in which a current flows through the third coil conductor on the second surface.

4. The coil antenna according to claim 1, wherein the peripheral surface further includes a second principal surface;

the coil antenna further comprises:

a third base material layer stacked on the second principal surface, including at least a third surface parallel or substantially parallel to the second principal surface; and a fourth coil conductor located on at least the third surface;

opposite ends of the fourth coil conductor are coupled to the first coil conductor on the second principal surface; and a direction in which a current flows through the first coil conductor on the second principal surface is the same or substantially the same as a direction in which a current flows through the fourth coil conductor on the third surface.

5. The coil antenna according to claim 1, wherein a line width of the first coil conductor located on the first principal surface is different from a line width of the second coil conductor located on the first surface.

6. The coil antenna according to claim 1, wherein a centerline of the first coil conductor located on the first principal surface is not overlapped with a centerline of the second coil conductor located on the first surface in a plan view when looking from a direction of a normal line with respect to the first principal surface.

7. The coil antenna according to claim 1, further comprising an insulating layer stacked on the first surface, and an electronic component disposed on the insulating layer.

8. The coil antenna according to claim 1, wherein a number of turns of the second coil conductors located on the first surface is smaller than a number of turns of the first coil conductor.

9. The coil antenna according to claim 4, wherein a number of turns of the fourth coil conductors located on the third surface is smaller than a number of turns of the first coil conductor.

10. A communication terminal device comprising:

an integrated circuit chip configured to generate a high-frequency signal modulated by data to be transmitted, or to reproduce data from a received high-frequency signal; and a coil antenna that is supplied with the high-frequency signal generated by the integrated circuit chip, or that outputs the high-frequency signal to the integrated circuit chip;

the coil antenna comprising:

a core including a peripheral surface including at least a first principal surface;

a first coil conductor located on the first principal surface and wound around a predetermined winding axis;

a first base material layer stacked on the first principal surface, including at least a first surface parallel or substantially parallel to the first principal surface; and a second coil conductor located on at least the first surface; wherein the second coil conductor is coupled to the first coil conductor on the first principal surface at least at two points so that the second coil conductor and the first coil conductor make a parallel circuit connection; and the predetermined winding axis of the first coil conductor extends in a direction that is parallel or substantially parallel to the first principal surface of the core.

11. The communication terminal device according to claim 10, wherein the core is a multilayer body comprising a plurality of layers.

12. The communication terminal device according to claim 10, wherein the coil antenna further comprises:

a second base material layer stacked on the first surface, including at least a second surface parallel or substantially parallel to the first principal surface; and a third coil conductor located on at least the second surface; wherein opposite ends of the third coil conductor are coupled to the second coil conductor on the first surface; and the direction in which a current flows through the first coil conductor on the first principal surface is the same or substantially the same as a direction in which a current flows through the third coil conductor on the second surface.

13. The communication terminal device according to claim 10, wherein the peripheral surface further includes a second principal surface;

the coil antenna further comprises:

a third base material layer stacked on the second principal surface, including at least a third surface parallel or substantially parallel to the second principal surface; and a fourth coil conductor located on at least the third surface;

opposite ends of the fourth coil conductor are coupled to the first coil conductor on the second principal surface; and a direction in which a current flows through the first coil conductor on the second principal surface is the same or substantially the same as a direction in which a current flows through the fourth coil conductor on the third surface.

14. The communication terminal device according to claim 10, wherein a line width of the first coil conductor located on the first principal surface is different from a line width of the second coil conductor located on the first surface.

15. The communication terminal device according to claim 10, wherein a centerline of the first coil conductor located on the first principal surface is not overlapped with a centerline of the second coil conductor located on the first surface in a plan view when looking from a direction of a normal line with respect to the first principal surface.

16. The communication terminal device according to claim 10, wherein the coil antenna further comprises an insulating layer stacked on the first surface, and an electronic component disposed on the insulating layer.

17. The communication terminal device according to claim 10, wherein a number of turns of the second coil conductors located on the first surface is smaller than a number of turns of the first coil conductor.

18. The communication terminal device according to claim 13, wherein a number of turns of the fourth coil conductors located on the third surface is smaller than a number of turns of the first coil conductor.

* * * * *